US011038310B2

(12) United States Patent
Tsai

(10) Patent No.: US 11,038,310 B2
(45) **Date of Patent: *Jun. 15, 2021**

(54) REVERSIBLE DUAL-POSITION ELECTRIC CONNECTOR

(71) Applicant: KIWI INTELLECTUAL ASSETS CORPORATION, Taoyuan (TW)

(72) Inventor: Chou Hsien Tsai, Taoyuan (TW)

(73) Assignee: KIWI INTELLECTUAL ASSETS CORPORATION, Taoyuan (TW)

( * ) Notice: Subject to any disclaimer, the term of this patent is extended or adjusted under 35 U.S.C. 154(b) by 0 days.

This patent is subject to a terminal disclaimer.

(21) Appl. No.: 16/627,507

(22) PCT Filed: Jul. 2, 2018

(86) PCT No.: PCT/CN2018/094123
§ 371 (c)(1),
(2) Date: Mar. 27, 2020

(87) PCT Pub. No.: WO2019/001586
PCT Pub. Date: Jan. 3, 2019

(65) Prior Publication Data

US 2020/0388970 A1 Dec. 10, 2020

Related U.S. Application Data

(60) Continuation-in-part of application No. 16/071,613, filed on Jul. 20, 2018, now Pat. No. 10,680,384, and
(Continued)

(30) Foreign Application Priority Data

Jun. 24, 2014 (CN) ..... 201420341035.7
Sep. 19, 2014 (CN) ..... 201420541444.1
(Continued)

(51) Int. Cl.
*H01R 24/60* (2011.01)
*H01R 13/6581* (2011.01)
(Continued)

(52) U.S. Cl.
CPC ..... *H01R 24/60* (2013.01); *H01R 13/502* (2013.01); *H01R 13/6581* (2013.01); *H01R 2107/00* (2013.01)

(58) Field of Classification Search
CPC ... H01R 24/60; H01R 13/502; H01R 13/6581
(Continued)

(56) References Cited

U.S. PATENT DOCUMENTS 9,142,926 B2 * 9/2015 Tsai ..... H01R 27/00
9,450,341 B2 * 9/2016 Kao ..... H01R 24/60
(Continued)

FOREIGN PATENT DOCUMENTS

CN 104505677 A 4/2015
CN 105024206 A 11/2015
(Continued)

OTHER PUBLICATIONS

China Patent Office "Office Action" dated Sep. 28, 2020.

*Primary Examiner* — Alexander Gilman
(74) *Attorney, Agent, or Firm* — WPAT, PC

(57) ABSTRACT

A bidirectional duplex electrical connector includes: two insulation seats; two rows of first terminals, wherein the first terminal has an elastically movable portion, a fixing portion and a pin, a front section of the elastically movable portion is curved to form a contact, and a rear section of the elastically movable portion and the fixing portion horizontally rest against the insulation seat, the insulation seat has a fixing structure fixing the fixing portions of the two rows of first terminals, and the rear sections still can elastically move; one row of second terminals, wherein the second
(Continued)

terminal has two elastic arms each having a contact projecting toward a middle, and the second terminal has a vertical plate surface; and a metal housing covering the two insulation seats.

20 Claims, 25 Drawing Sheets

Related U.S. Application Data a continuation-in-part of application No. 16/166,433, filed on Oct. 22, 2018, now Pat. No. 10,833,463, which is a division of application No. 15/321,373, filed as application No. PCT/CN2015/082256 on Jun. 24, 2015, now Pat. No. 10,109,966, and application No. 16/071,613, filed as application No. PCT/CN2017/072259 on Jan. 23, 2017.

(60) Provisional application No. 62/281,756, filed on Jan. 22, 2016.

(30) Foreign Application Priority Data

Feb. 17, 2015 (CN) ..... 201520114091.1
Jun. 30, 2017 (CN) ..... 201720781911.1

(51) Int. Cl.
*H01R 13/502* (2006.01)
*H01R 107/00* (2006.01)

(58) Field of Classification Search
USPC ..... 439/676
See application file for complete search history.

(56) References Cited

U.S. PATENT DOCUMENTS

| | | | | |
|---|---|---|---|---|
| 9,450,342 | B2 * | 9/2016 | Wu | H01R 13/6593 |
| 9,478,905 | B2 * | 10/2016 | Golko | H01R 29/00 |
| 9,478,918 | B1 * | 10/2016 | Yin | H01R 13/6315 |
| 9,640,911 | B2 * | 5/2017 | Chen | H01R 13/642 |
| 9,667,007 | B2 * | 5/2017 | Terlizzi | H01R 13/641 |
| 9,728,885 | B2 * | 8/2017 | Yokoyama | H01R 13/6585 |
| 9,806,464 | B1 * | 10/2017 | Wang | H01R 13/6474 |
| 10,103,499 | B2 * | 10/2018 | Tsai | H01R 13/506 |
| 10,103,505 | B1 * | 10/2018 | Izaki | H01R 31/06 |
| 10,547,147 | B2 * | 1/2020 | Taniguchi | H01R 12/53 |
| 10,714,876 | B2 * | 7/2020 | Zhao | H01R 24/60 |
| 2013/0005193 | A1 | 1/2013 | Tsai | |
| 2015/0044886 | A1 * | 2/2015 | Little | H01R 13/6582 439/55 |
| 2015/0171561 | A1 * | 6/2015 | Little | H01R 13/6581 439/607.34 |
| 2016/0156144 | A1 * | 6/2016 | Kao | H01R 13/6581 439/676 |
| 2016/0204540 | A1 * | 7/2016 | Chen | H01R 24/70 439/660 |
| 2017/0040761 | A1 * | 2/2017 | Tsai | H01R 24/64 |
| 2017/0194754 | A1 * | 7/2017 | Tsai | H01R 24/60 |
| 2017/0279226 | A1 * | 9/2017 | Tsai | H01R 13/6581 |
| 2017/0294749 | A1 * | 10/2017 | Tsai | H01R 24/60 |
| 2017/0352990 | A1 * | 12/2017 | Zhao | H01R 13/6591 |
| 2018/0175529 | A1 * | 6/2018 | Wang | H01R 12/721 |
| 2018/0294604 | A1 * | 10/2018 | Chien | H01R 13/41 |
| 2018/0351282 | A1 * | 12/2018 | Duan | H01R 13/6585 |
| 2019/0027868 | A1 * | 1/2019 | Tsai | H01R 13/112 |

FOREIGN PATENT DOCUMENTS

| | | | |
|---|---|---|---|
| CN | 105048151 | A | 11/2015 |
| CN | 105186157 | A | 12/2015 |
| CN | 205081305 | U | 3/2016 |
| CN | 205565178 | U | 9/2016 |
| CN | 105990785 | A | 10/2016 |

* cited by examiner

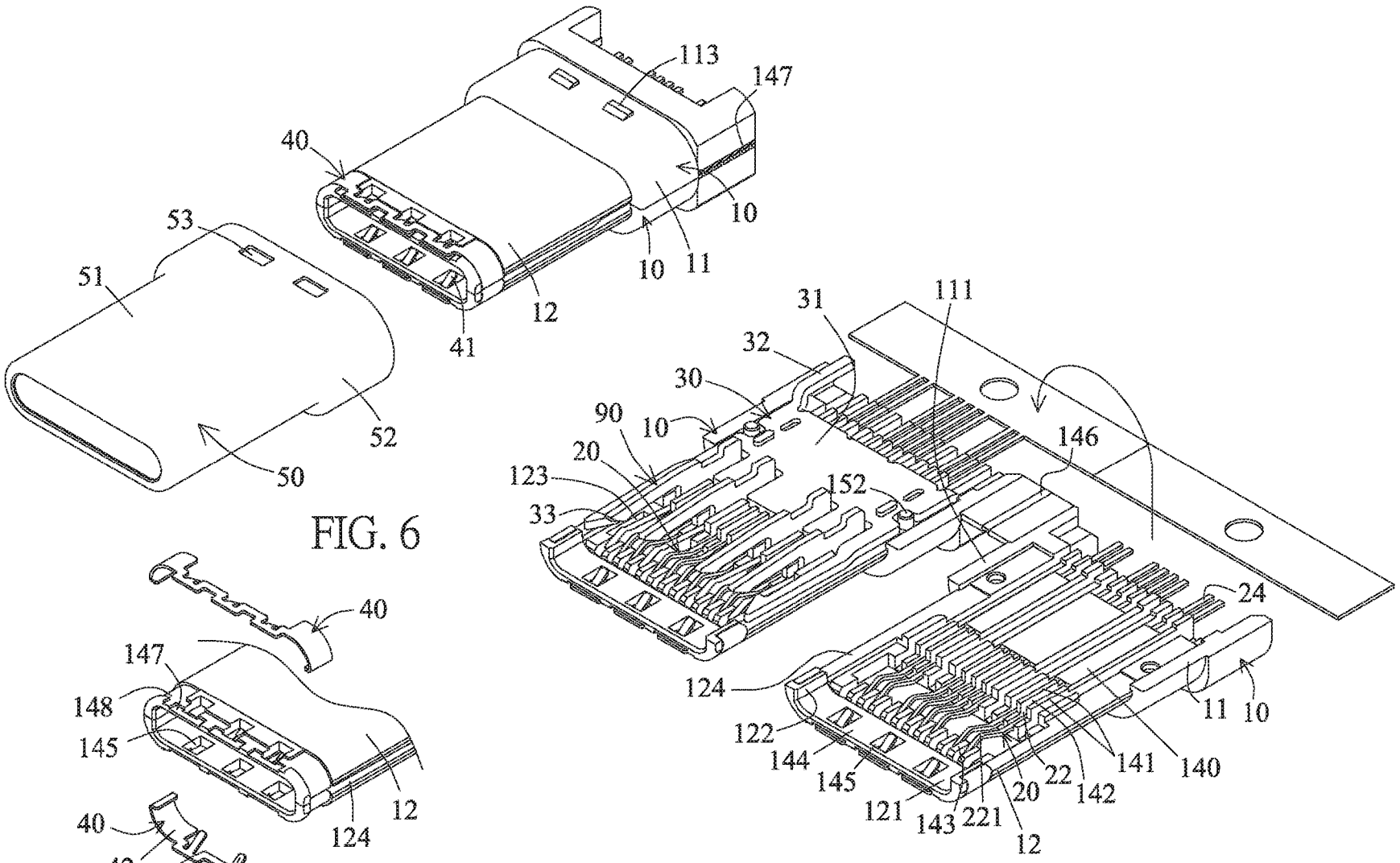
FIG. 6
FIG. 8
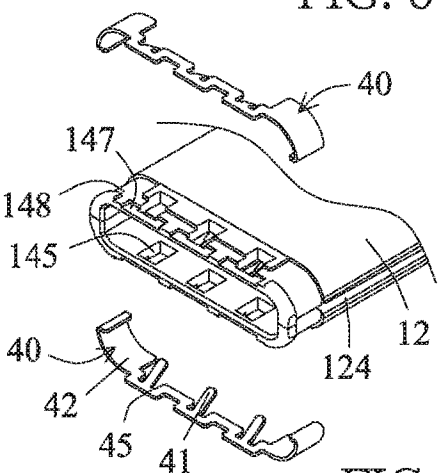
FIG. 7

921
928

90
921
927
10
20

94
93
90
92
921
A12
B1
A9
B4
B9
A4
A1
B12
66
68
60
68
B2
20
B11
A2
221(A11)
22
223
20
23
24
10
146
142
141
149

REVERSIBLE DUAL-POSITION ELECTRIC CONNECTOR

CROSS-REFERENCE TO RELATED APPLICATIONS

This application is a national stage application of PCT Patent Application No. PCT/CN2018/094123, filed on Jul. 2, 2018, which claims priority to China Patent Application Ser. No. 201720781911.1, filed on Jun. 30, 2017, the content of which is incorporated herein by reference. This application is also a CIP (continuation-in-part) of pending U.S. patent application Ser. No. 16/071,613, filed on Jul. 20, 2018, and pending U.S. patent application Ser. No. 16/166,433, filed on Oct. 22, 2018, the contents of which are incorporated herein by reference.

BACKGROUND OF THE INVENTION

Field of the Invention

The invention relates to an electrical connector, and more particularly to a bidirectional duplex electrical connector.

Description of the Related Art

At present, because the functions of various electronic products are becoming more and more powerful and handheld devices are also becoming more and more popular, the demands for signal transmission between various products or devices are increasing, wherein the signal transmission between these devices are conducted through signal interfaces. The signal interface may be, for example, an electrical connector or a complementary electrical connector docking therewith. The electrical connector is an electrical receptacle, and the complementary electrical connector is an electrical plug.

Before docking between the electrical plug and the electrical receptacle, the electrical plug needs to face the electrical receptacle in a correct direction so that the docking can be performed. That is, the electrical receptacle has the inserting connection orientation, which is the so-called mistake-proof function. This function is to ensure the connection interface on the electrical plug to contact the contact terminal on the electrical receptacle. However, most users do not have the habit of placing the electrical plug to face the electrical receptacle in the correct direction, and this mistake-proof function causes docking failure between the electrical plug and the electrical receptacle. Then, the user flips the electrical plug to perform the correct docking. In other words, this mistake-proof function brings troubles to the user on the contrary.

Therefore, a bidirectional electrical connector having a duplex docking function is available on the market and is provided with two sets of contact terminals to eliminate the inserting connection orientation of the bidirectional electrical connector. The user can dock the bidirectional electrical connector with the complementary electrical connector in either direction. However, the conventional bidirectional electrical connector has the high manufacturing cost, and the low reliability of the function. Based on this, how to make the bidirectional electrical connector have the stable reliability and decrease the cost of the electrical connector becomes the goal of the common efforts of the industries.

BRIEF SUMMARY OF THE INVENTION

A main object of the invention is to provide a bidirectional duplex electrical connector, wherein the manufacturing and assembling costs can be decreased, and the duplex docking function can be provided.

Another main object of the invention is to provide a bidirectional duplex electrical connector, wherein one row of four loose-pin type and female-fork type terminals are adopted as ground and power terminals so that the larger plate surface area can be obtained, wherein the four terminals have grounding contacts aligned in an up-down direction and power contacts aligned in an up-down direction.

To achieve the above-identified object, the invention provides a bidirectional duplex electrical connector, including: two insulation seats, wherein each of the insulation seats is integrally provided with a base portion and a docking portion, the docking portion is connected to a front end of the base portion, the docking portion is provided with a baseplate and two side plates, the base portions of the two insulation seats are stacked in an up-down direction, a connection slot is formed between the baseplates of the docking portions of the two insulation seats, the two side plates of the docking portions of the two insulation seats mutually rest against each other to form a fitting frame body, and each of inner surfaces of the two insulation seats is provided with one row of separation columns performing separation to form one row of front-to-rear extending terminal slots; two rows of first terminals formed by bending and stamping metal plate sheets, wherein the two rows of first terminals are assembled into two rows of terminal slots of the two insulation seats in the up-down direction, the first terminal is integrally provided with, from front to rear, an elastically movable portion, a fixing portion and a pin, a front section of the elastically movable portion corresponds to the docking portion and is curved and provided with a contact projecting in the up-down direction, the elastically movable portion is elastically movable up and down, a rear section of the elastically movable portion and the fixing portion are on the same level and rest against a bottom surface of the terminal slot, and a depth of the terminal slot is larger than a material thickness of the first terminal, so that the rear section of the elastically movable portion and the fixing portion fall into the terminal slot, the insulation seat is provided with a fixing structure fixing the fixing portions of the one row of first terminals, the rear sections of the elastically movable portions of the one row of first terminals still can rest against the bottom surfaces of the terminal slots to elastically move up and down, the pin extends to a rear end of the base portion and is exposed, and the contacts of the two rows of first terminals having connection points with the same circuit serial numbers are arranged reversely; one row of second terminals, which are one row of loose-pin type terminals and are formed by pressing a metal plate sheet, wherein the second terminal is integrally provided with two elastic arms, a fixing portion and a pin, the two elastic arms have a harpoon-like shape, each of the two elastic arms is provided with a contact projecting toward a middle, the two contacts are aligned in the up-down direction with a gap formed between the two contacts, the two elastic arms are elastically movable up and down in a direction parallel to a plate surface direction, the one row of second terminals are assembled, in the up-down direction, into two rows of terminal slots of the two insulation seats, and the second terminal has a vertical plate surface; and a metal housing, which covers the two insulation seats and is provided with a four-sided main housing, wherein the four-sided main housing covers the docking portions of the two insulation seats to form a docking structure, and the docking structure can be positioned with a docking electrical connector in a dual-positional and bidirectional manner.

The above-mentioned and other objects, advantages and features of the invention may become more apparent from the following detailed description of the preferred embodiments with reference to the accompanying drawings.

BRIEF DESCRIPTION OF THE SEVERAL VIEWS OF THE DRAWINGS

FIG. 6 is a pictorially exploded view showing to the first embodiment of the invention.

FIG. 7 is a pictorially exploded view showing to the first embodiment of the invention.

FIG. 8 is a pictorial view showing two insulation seats 10 opened according to the first embodiment of the invention.

DETAILED DESCRIPTION OF THE INVENTION

Figure 1:
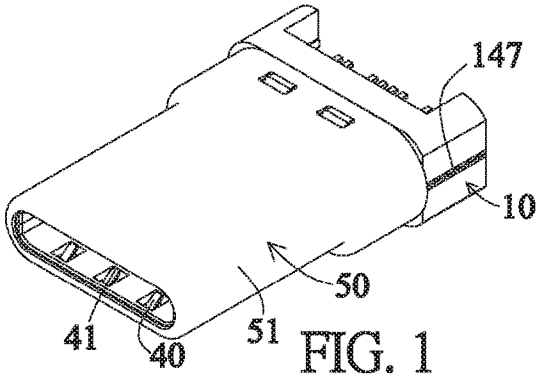
FIG. 1 is a pictorial view showing the first embodiment of the invention.

Referring to FIGS. 1 to 16, a bidirectional duplex USB TYPE-C 3.0 electrical plug according to the first embodiment of the invention includes two insulation seats 10, two rows of contacts, a metal partition plate 30, two ground members 40, and a metal housing 50.

The insulation seat 10 is integrally provided with a base portion 11 and a docking portion 12. The docking portion 12 is connected to the front end of the base portion 11. The inner surfaces of the base portions 11 of the two insulation seats are provided with connection surfaces 111 resting against each other. One of the insulation seats is provided with an engagement hole 151 engaging with an engagement column 152 of the other insulation seat. The rear section of the base portion 11 is higher than the front section thereof and the outer surface of the rear section is provided with an engagement block 113. The docking portion 12 is provided with a baseplate 121 and two side plates 122. The two side plates 122 are connected to left and right sides of the baseplate 121. The front section of the inner surface of the baseplate 12 is provided with a front section surface 144, and the rear section of the inner surface of the baseplate 12 is provided with a rear section surface 143. The rear section surface 143 projects beyond the front section surface 144 by a height. The front section surface 144 is provided with three through holes 145. The inner surface of the insulation seat 10 is provided with one row of separation columns 141 performing separation to form one row of front-to-rear extending terminal slots 142. The terminal slot 142 extends from the base portion 11 to the docking portion 12, and the terminal can be placed into the terminal slot in the up-down direction. The front section of the outer surface of the baseplate 12 is provided with a concave surface 148, and the portions corresponding to the front of the three through holes 145 are provided with three more concave surfaces 147, which are more concave than the three concave surfaces 148. First sides of the base portions of the two insulation seats 20 are respectively integrally provided with two plastic material bridges 146 mutually connected together. When one insulation seat 10 is flipped by 180 degrees, the two insulation seats 20 are stacked in the up-down direction, the connection surfaces 111 of the base portions of the two insulation seats rest against each other, the front sections of the two side plates 122 of the docking portions 12 of the two insulation seats are higher and connected together, and the middle section thereof is lower and formed with an opening 124. A connection slot 125 is formed between the inner surfaces of the baseplates 121 of the two insulation seats.

Figure 3:
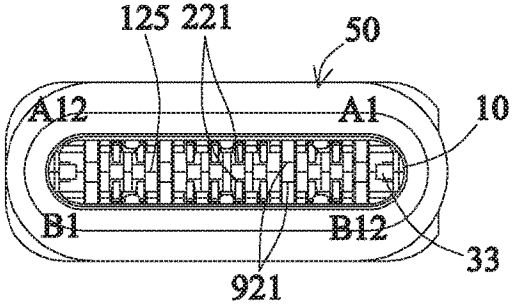
FIG. 3 is a front view showing the first embodiment of the invention.

The two rows of contacts are shown in FIG. 3, wherein the upper row of contacts are represented by A, the connection points with the circuit serial numbers A1 to A12 sequentially arranged from right to left, the lower row of contacts are represented by B, and the connection points with the circuit serial numbers B12 to B1 sequentially arranged from right to left. The two rows of contacts are arranged according to the connection points with the circuit serial numbers in an equally spaced manner, and the connection points of the two rows of contacts with the same circuit serial numbers are arranged reversely. The two rows of contacts are formed on the two rows of terminals 20 and the one row of terminals 90. The two rows of terminals 20 are two rows of first terminals, and the one row of terminals 90 are one row of first terminals.

The two rows of terminals 20 are assembled into the two rows of terminal slots 142 of the two insulation seats 10 in the up-down direction, and each of the rows of terminals 20 have 8 terminals, which are continuous terminals formed by bending and stamping a plate sheet. When being manufactured, the overall row of terminals are connected to a material tape and then assembled into the two insulation seats 10, the connection points of the upper row of terminals 20 with the circuit serial numbers arranged from right to left as A2, A3, A5, A6, A7, A8, A10, A11, A2, A3, . . . , A12 in order, and the connection points of the lower row of terminals 20 with the circuit serial numbers arranged from right to left as B11, B10, B8, B7, B6, B5, B3, B2 in order. Each terminal 20 is integrally provided with an elastically movable portion 22, a fixing portion 23 and a pin 24 from front to rear, the front section of the elastically movable portion 22 corresponds to the depression area 123 of the docking portion, and is curved and provided with a contact 221 projecting beyond the rear section surface 143 in the up-down direction. The elastically movable portion 22 is elastically movable up and down, and the rear section 223 of the elastically movable portion and the fixing portion 23 are on the same level and resting against the bottom surface of the terminal slot 142. The depth of the terminal slot 142 is greater than the material thickness of the terminal, so that the rear section 223 of the elastically movable portion and the fixing portion 23 fall into the terminal slot 142. Then, a fixing structure 140 is formed at the position corresponding to the fixing portion 23 by way of secondary processing and encapsulant. The fixing structure 140 covers the fixing portions 23 of the one row of terminals 20 and has a plane slightly depressed from the connection surface 111. The pin 24 horizontally extends out of the rear end of the base portion. In addition, the front end of the front fixing portion 21 has an electroplate-free layer 25 exposing from the front end of the insulation seat 10.

Figure 5:
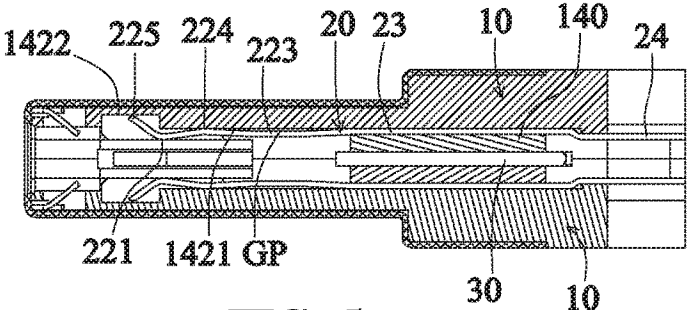
FIG. 5 is a cross-sectional side view showing the first embodiment of the invention (the elastically movable state of the terminal 20).
Figure 2:
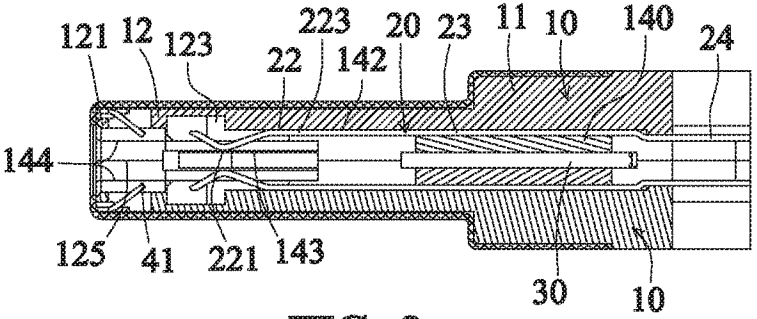
FIG. 2 is a cross-sectional side view showing the first embodiment of the invention.
Figure 4:
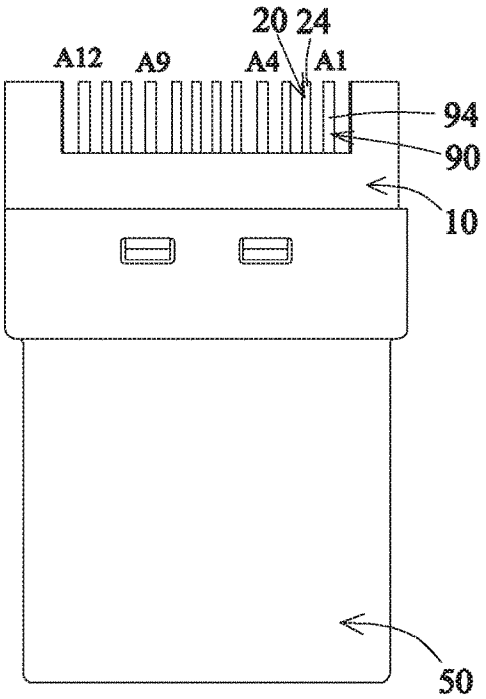
FIG. 4 is a top view showing the first embodiment of the invention.

As shown in FIG. 5, when the elastically movable portions 22 of the two rows of terminals are forced to elastically move, the rear section of the elastically movable portion of the terminal horizontally rests, according to principles of mechanics, against the bottom surface of the terminal slot to have the support effect of the middle section of the elastic arm. That is, the elastically movable portion is formed with a middle section fulcrum 224, which is supported by a terminal-slot bottom surface 1421. That is, when the contact 221 is forced to elastically moved toward the bottom surface of the terminal slot 1421, the rear section 223 of the elastically movable portion after the middle section fulcrum 224 is reversely elastically moved, so that the rear section 223 of the elastically movable portion exclusive of the middle-section fulcrum 224 can be partially separated from the bottom surface of the terminal slot 1421 and is curved to move elastically to form a gap GP between the bottom surface of the terminal slot 1421 of the base portion and the rear section of the elastically movable portion. Thus, the contact normal force and resilience of the terminal can be increased.

Figure 12:
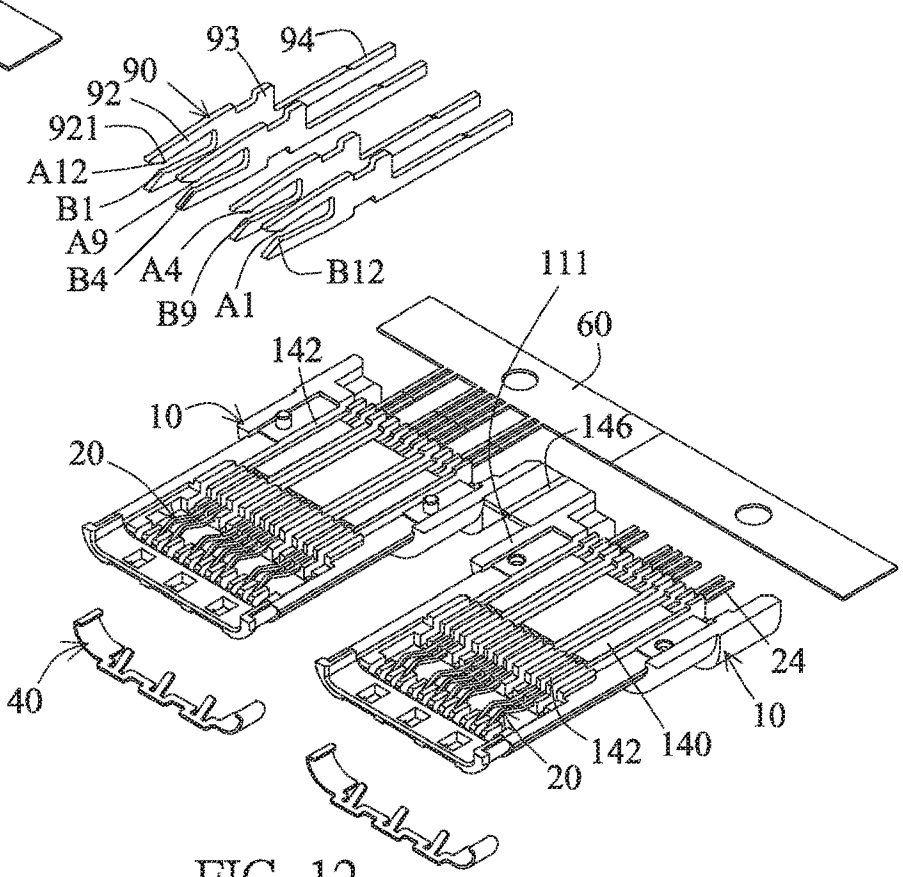
FIG. 12 is a pictorial view showing the manufacturing process according to the first embodiment of the invention.

Referring to FIG. 12, the one row of terminals 90 have 4 loose-pin type female-fork terminals, the terminals 90 are formed by pressing a plate sheet, and the terminal 90 is provided with two elastic arms 92, a fixing portion 93 and a pin 94. The two elastic arms 92 have a harpoon-like shape. Each of the two elastic arms is provided with a contact 921 projecting toward the middle. The contacts 921 are aligned in an up-down direction with a gap formed therebetween. The two elastic arms 92 are elastically movable up and down in a direction parallel to the plate surface. The upper row of contacts 921 of the one row of terminals 90 are arranged from right to left as A1, A4, A9 and A12 in order. The lower row of contacts 921 of the one row of terminals 90 are arranged from right to left as B12, B9, B4 and B1 in order. The one row of terminals 90 are assembled into the two rows of terminal slots 142 of the two insulation seats 10 in the up-down direction. The terminal has a vertical plate surface.

The connection points with the circuit serial numbers according to the USB TYPE-C specified by USB Association will be explained in the following: 1 and 12 are one pair of ground terminals arranged in a left-right symmetrical manner; 4 and 9 are one pair of power terminals arranged in a left-right symmetrical manner; 2 and 3 are one pair of high differential signal terminals (TX+, TX−); 10 and 11 are the other one pair of high differential signal terminals (RX+, RX−); 6 and 7 are one pair of low differential signal terminals (D+, D−); and 5 and 8 are detection terminals, wherein the ground terminal and the power terminal have the requirement of transmitting the high current, and the other terminals do not have the requirement of transmitting the high current. Also, the grounding contacts A1/B12, A12/B1 aligned in the up-down direction need to electrically connected together, and the power contacts A4/B9, A9/B4 aligned in the up-down direction need to electrically connected together. So, this implementation adopts one row of four female-fork type terminals 90, which are respectively the grounding contacts A1/B12, A12/B1 aligned in the up-down direction and the power contacts A4/B9, A9/B4 aligned in the up-down direction. The plate surface of the terminal 90 are vertically assembled into the terminal slot, and can be designed to have the larger area of plate surface to exceed the plate surface area of the two rows of terminals 20.

The metal partition plate 30 is disposed between the two insulation seats 10 and connected to the fixing portion 40. The metal partition plate 30 is provided with a main plate surface 31. Each of left and right sides of the main plate surface 31 extends frontwards and is integrally provided with a resilient snap 33, and extends backwards and is integrally provided with a horizontal pin 32. The resilient snap 33 can correspond to the opening 124 to elastically move in the left-right direction.

The two ground members 40 are respectively connected to and positioned at the outer surfaces of the baseplate 121 of the docking portions 12 of the two insulation seats 10, and the ground member 40 provided with a positioning sheet 42 and a twisting sheet 45. The twisting sheet 45 is disposed at the middle of the positioning sheet and is curve-shaped to form a continuous U-shape in the front-to-rear direction. The twisting sheet 45 is integrally connected to and provided with three elastic sheets 41. The three elastic sheets 41 are elastically movable up and down, and each of two of the elastic sheets 41 is formed with a U-shaped sheet body. The positioning sheet 42 and the twisting sheet 45 of the ground member 40 are placed on the concave surface 148 of the outer surface of the baseplate 121. The three elastic sheets 41 pass through the three through holes 145 and project beyond the front section surface 144.

The metal housing 50 is formed by metal pulling and extending and covers the two insulation seats 10 and rests against the two ground members 40. The metal housing 50 is provided with a four-sided main housing 51 and a positioning portion 52. The four-sided main housing 51 covers the docking portions 12 of the two insulation seats 10 to form a docking structure. The docking structure can be positioned with a docking electrical connector in a dual-positional and bidirectional manner. The positioning portion 52 is higher than the four-sided main housing 51 and is provided with an engagement hole 53 engaging with the engagement block 113.

The method of manufacturing this embodiment will be described in the following.

Figure 9:
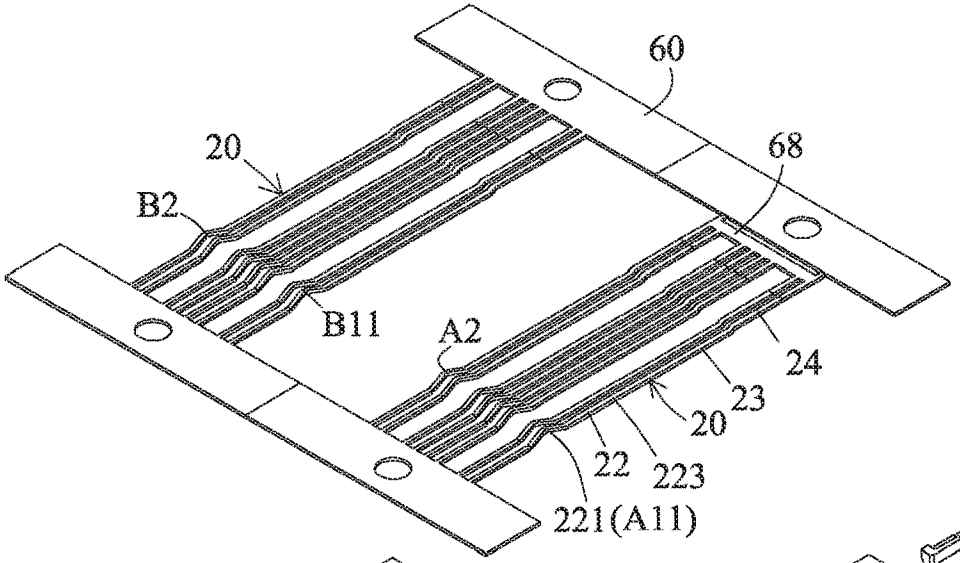
FIG. 9 is a pictorial view showing the manufacturing process according to the first embodiment of the invention.
Figure 9:
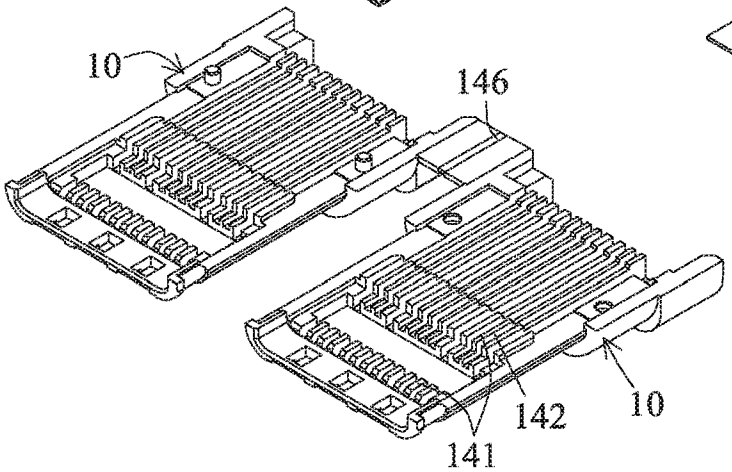

Referring to FIG. 9, the two rows of terminals 20 are provided. The two rows of terminals 20 are formed by stamping the same metal sheet and are arranged adjacently and have two ends connected to a material tape 60. The material tape 60 is provided with a sub-material tape 68 connected to the upper row of terminals. The two rows of terminals 20 have the connection points with the same circuit serial numbers arranged sequentially and in the same direction. In addition, the two insulation seats 10 are provided. The two insulation seats 10 are integrally plastic injection molded. One side of the base portion 11 of each of the two insulation seats 20 is integrally provided with a plastic material bridge 146, and the plastic material bridges 146 are mutually connected together.

Figure 10:
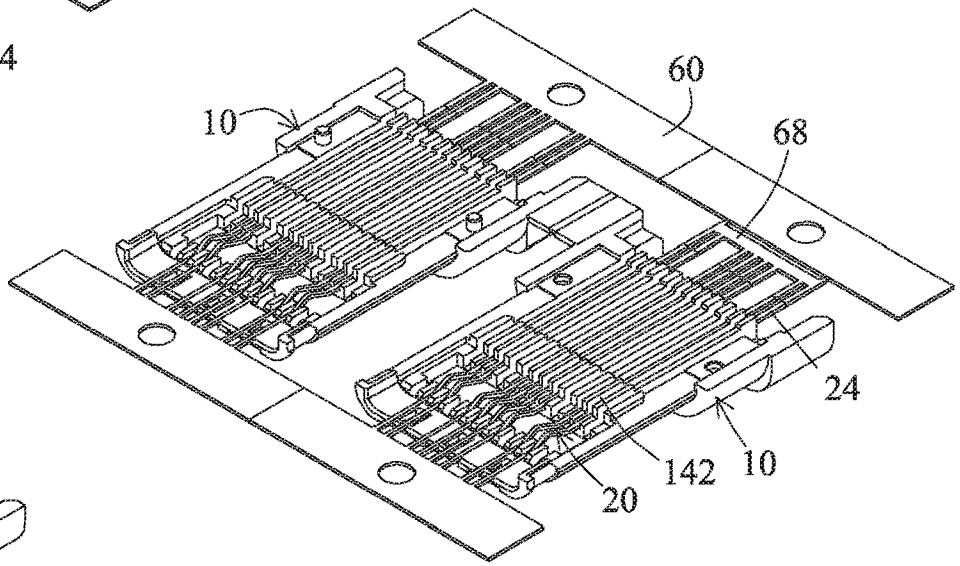
FIG. 10 is a pictorial view showing the manufacturing process according to the first embodiment of the invention.

Referring to FIG. 10, the two rows of terminals 20 are then assembled into the two rows of terminal slots 142 of the two insulation seats 10 in the up-down direction. The rear sections 223 of the elastically movable portions and the fixing portions 23 of the two rows of terminals 20 are on the same level and rest against the bottom surfaces of the two rows of terminal slots 142 of the two insulation seats 10. The depth of the terminal slot 142 is greater than the material thickness of the terminal 20, so that the rear section 223 of the elastically movable portion and the fixing portion 23 fall into the terminal slot 142.

Figure 11:
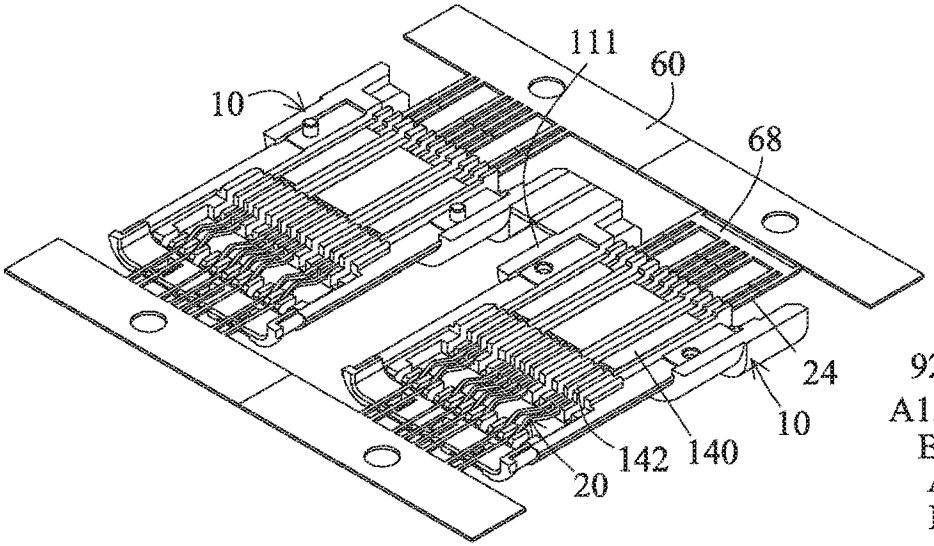
FIG. 11 is a pictorial view showing the manufacturing process according to the first embodiment of the invention.

Referring to FIG. 11, the encapsulant is then provided at the position corresponding to the fixing portion 23 by way of secondary processing to form the fixing structure 140, wherein the fixing structure 140 covers the fixing portions 23 of the one row of terminals 20 and is in the form of a plane slightly depressed from the connection surface 111.

Referring to FIG. 12, the one row of terminals 90 are then assembled onto the docking portion 12 of one row of terminal slots 142 of the insulation seat 10, and the two ground members 40 are assembled onto the outer surfaces of the docking portions 12 of the two insulation seats 10. At this time, the material tape 60 on the front ends of the two rows of terminals is cut off, and then the sub-material tape on the rear ends of one row of terminals 20 on the other insulation seat 10 is cut off.

Figure 13:
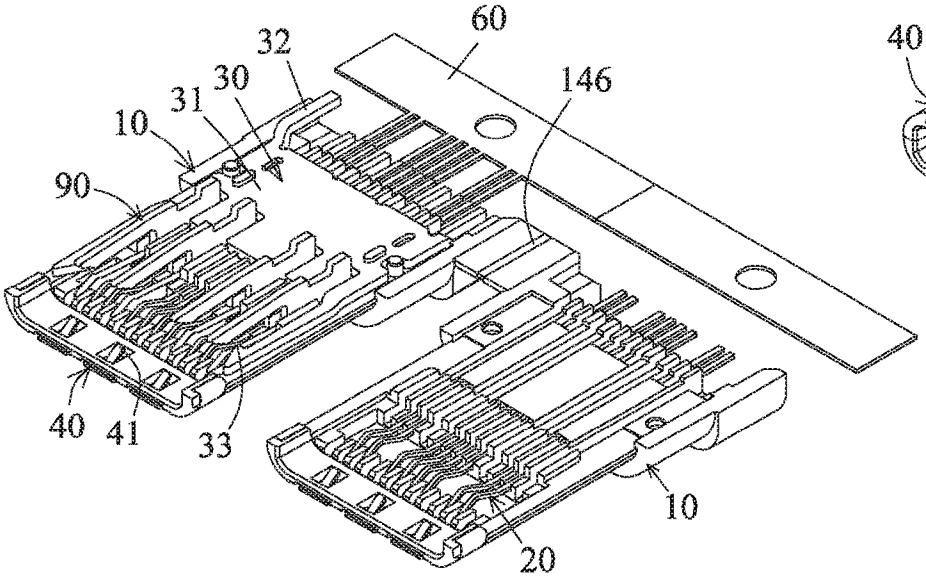
FIG. 13 is a pictorial view showing the manufacturing process according to the first embodiment of the invention.

Referring to FIG. 13, the metal partition plate 30 is provided and placed on the fixing structure 140 of one insulation seat 10.

Figure 14:
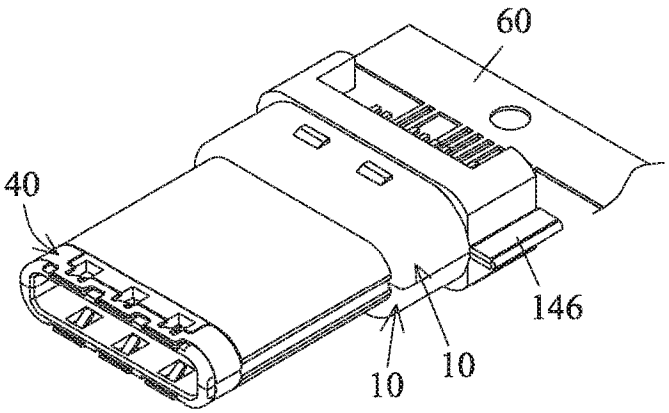
FIG. 14 is a pictorial view showing the manufacturing process according to the first embodiment of the invention.

Referring to FIG. 14, the insulation seat 10 is then separated from the material tape flipped by 180 degrees and stacked over the other insulation seat 10, and the two insulation seats 20 are stacked in the up-down direction. At this time, two rows of terminals 20 having the connection points with the same circuit serial numbers are arranged reversely in order.

Figure 15:
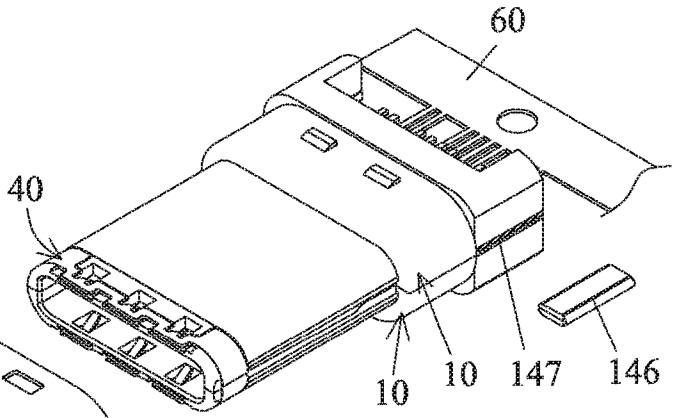
FIG. 15 is a pictorial view showing the manufacturing process according to the first embodiment of the invention.
Figure 15:
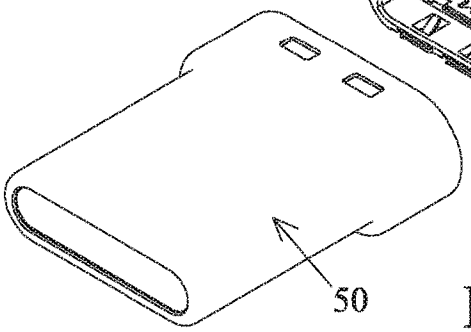

Referring to FIG. 15, the plastic material bridge 146 on one side of the two insulation seats 10 is then cut off, one side of each of the two insulation seats 10 is formed with a cut mark 147, and finally the metal housing 50 is assembled, from front to rear, to cover and be fixed to the two insulation seats 10.

Furthermore, the fixing structures of the two insulation seats 20 for fixing the terminals 20 may also lock the terminals by hot melting the separation columns between the terminal slot 142, or the terminal slot 142 is provided with the slot structure. When the terminal is placed into the terminal slot in the up-down direction and then shifted in a front-rear direction, the slot structure can lock the fixing portion of the terminal.

Figure 16:
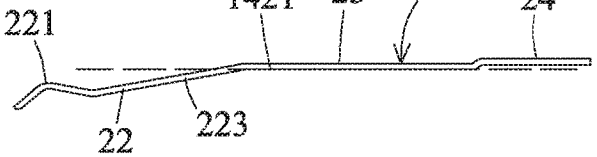
FIG. 16 is a schematic side view showing the terminal according to the first embodiment of the invention.

Referring to FIG. 16, when the two rows of terminals 20 are assemble with the terminal slots 142, the elastically movable portion 22 has the resilient overpressure toward the bottom surface of the terminal slot 1421 to ensure the two rows of terminals 20 to have the consistent elastic movement heights when being assembled with the terminal slots 142. That is, each row of contacts 221 can have a uniform height.

According to the structural explanation, the invention has the following advantages.

First, because the rear sections 223 of the elastically movable portions and the fixing portions 23 of two rows of terminals are on the same level and rest against the bottom surfaces of the terminal slots, easy assembling can be achieved and stamping can be simplified, the manufacturing cost can be decreased, and the rear section of the elastically movable portion of the terminal horizontally rests against the bottom surface of the terminal slot so that the support effect of the middle section of the elastic arm can be obtained, thereby increasing the normal force of contacting the terminal and the resilience.

Second, two plastic seats 10 are integrally formed by way of plastic injection molding and are integrally connected together via the plastic material bridge 146, so that the assembling speed is doubled.

Third, the ground terminal and the power terminal have the requirements of transmitting the high current. In the design of this embodiment, one row of four loose-pin type female-fork type terminals 90 are adopted, so that the larger plate surface area can be obtained and the 4 terminals 90 are respectively the grounding contacts A1/B12, A12/B1 aligned in the up-down direction and the power contacts A4/B9, A9/B4 aligned in the up-down direction.

Fourth, when the two rows of terminals 20 are assemble with the terminal slots 142, the elastically movable portion 22 has the resilient overpressure toward the bottom surface of the terminal slot 1421 to ensure the two rows of terminals 20 to have the consistent elastic movement heights when being assembled with the terminal slots 142. That is, each row of contacts 221 can have a uniform height.

Figure 17:
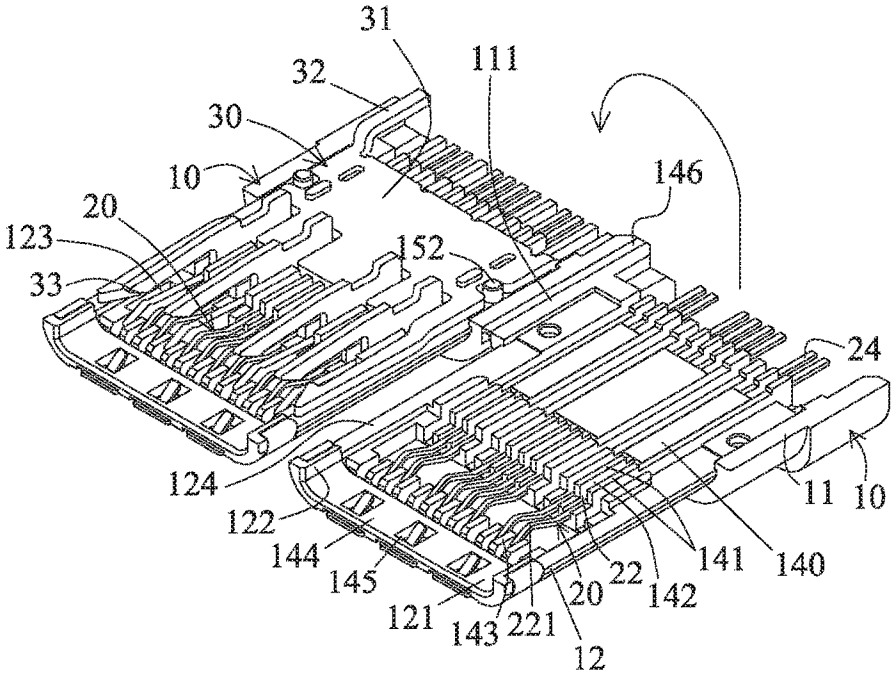
FIG. 17 is a pictorial view showing two insulation seats 10 opened according to the first modified implementation of the first embodiment of the invention.
Figure 18:
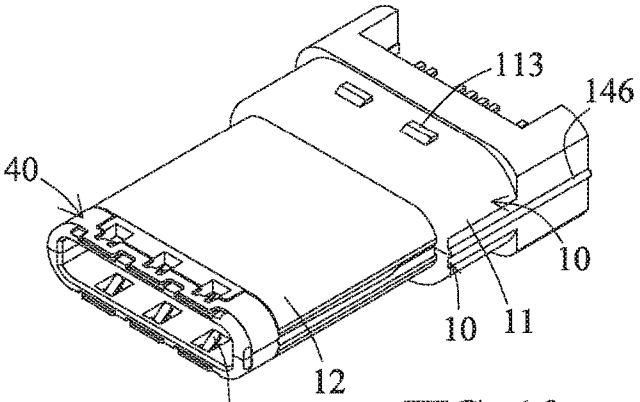
FIG. 18 is a pictorial view showing two insulation seats 10 stacked according to the first modified implementation of the first embodiment of the invention.

Referring to FIG. 17 and FIG. 18, the first modified implementation of the first embodiment of the invention is substantially the same as the first embodiment except for the difference that the plastic material bridge 146 is smaller and needs not to be cut off.

Figure 19:
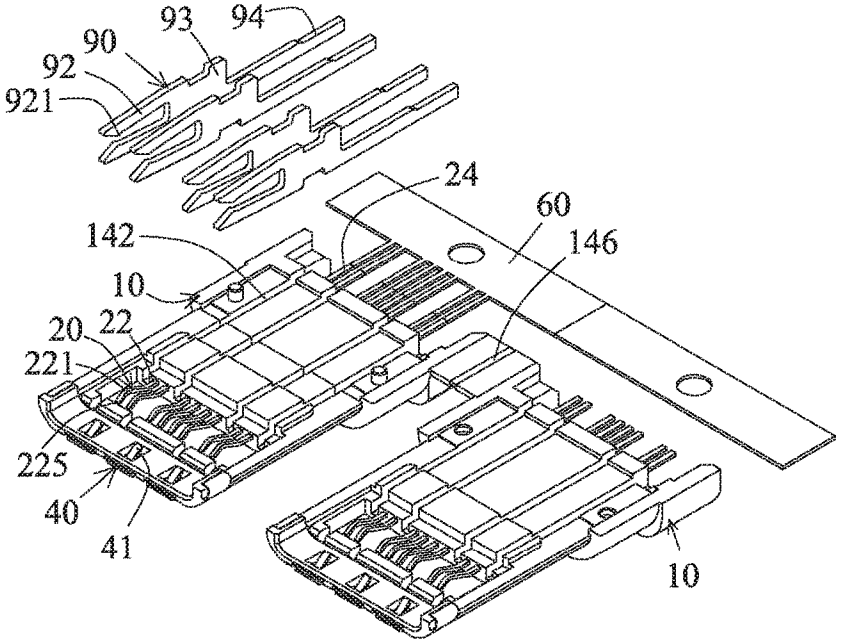
FIG. 19 is a pictorially exploded view showing the second modified implementation of the first embodiment of the invention.
Figure 20:
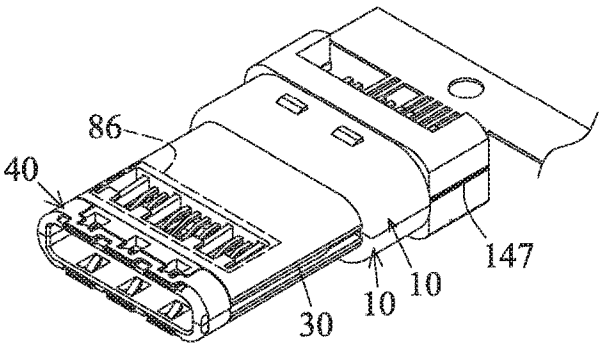
FIG. 20 is a pictorial view showing two insulation seats 10 stacked according to the first modified implementation of the first embodiment of the invention.

Referring to FIG. 19 and FIG. 20, the second modified implementation of the first embodiment of the invention is substantially the same as the first embodiment except for the difference that the two rows of terminals 20 of this modified implementation are cantilever arm type terminals. That is, the distal end of the elastically movable portion 22 is suspended, so that insulation films 86 can be attached to the two insulation seats 10 corresponding to the elastically movable portions 22 to prevent the elastically movable portions 22 from contacting the metal housing.

Figure 21:
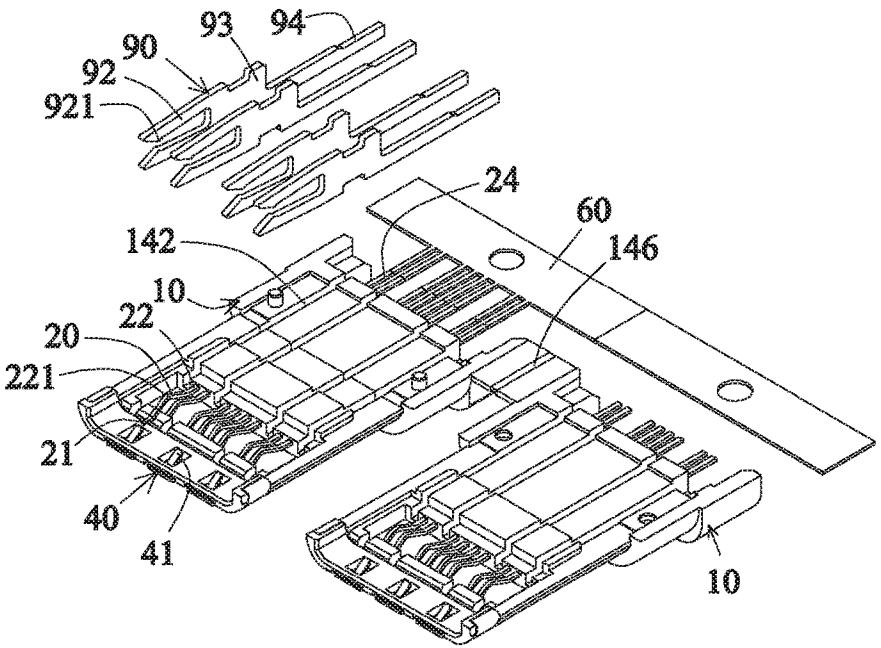
FIG. 21 is a pictorially exploded view showing the third modified implementation of the first embodiment of the invention.

Referring to FIG. 21, the third modified implementation of the first embodiment of the invention is substantially the same as the first embodiment except for the difference that the front ends 21 of the two rows of terminals 20 of this modified implementation are fixed to the insulation seat 10.

Figure 22:
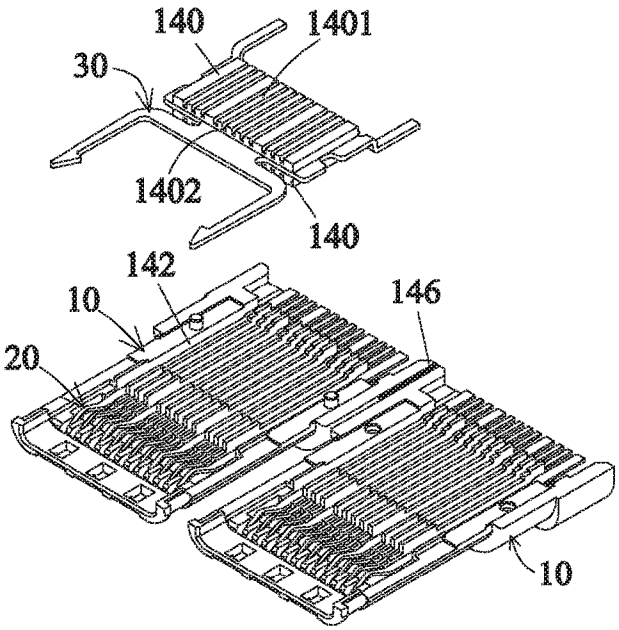
FIG. 22 is a pictorially exploded view showing the fourth modified implementation of the first embodiment of the invention.
Figure 23:
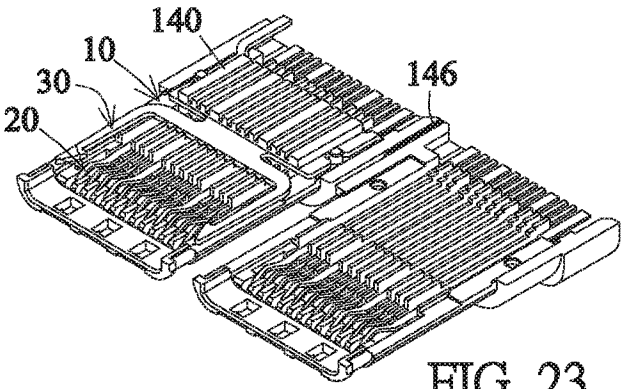
FIG. 23 is a pictorially assembled view showing the fourth modified implementation of the first embodiment of the invention.

Referring to FIG. 22 and FIG. 23, the fourth modified implementation of the first embodiment of the invention is substantially the same as the first embodiment except for the difference that each of the two rows of terminals 20 of this modified implementation have 12 terminals, and no female-fork type terminal is provided. The top and bottom surfaces of the metal partition plate 30 are embedded into and plastic injection molded with the fixing structures 140, wherein the fixing structures 140 are filled into the terminal slots 142 to fix each terminal. The fixing structure 140 is an insulator, which is assembled between the two insulation seats 10 and rests against and fix the fixing portions of the two rows of terminals 20. The top and bottom surfaces of the fixing structure 140 is provided with multiple convex surfaces 1401 and multiple concave surfaces 1402, which are spaced apart, respectively. The multiple convex surfaces 1401 can extend into the two rows of terminal slots 142 to fix the fixing portion of each terminal.

Figure 24:
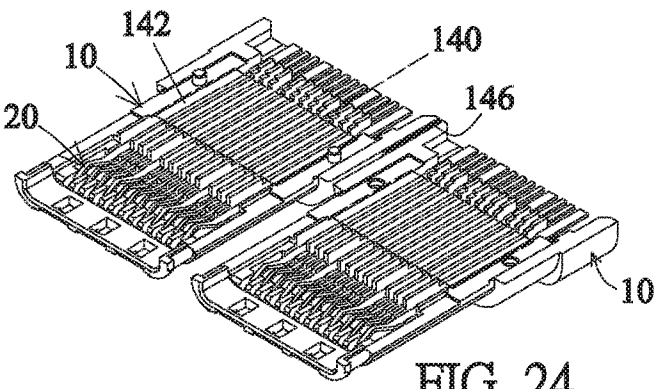
FIG. 24 is a pictorially assembled view showing the fifth modified implementation of the first embodiment of the invention.

Referring to FIG. 24, the fifth modified implementation of the first embodiment of the invention is substantially the same as the fourth modified implementation except for the difference that the fixing structure 140 is an insulation film.

Figures 25, 25A, 25B:
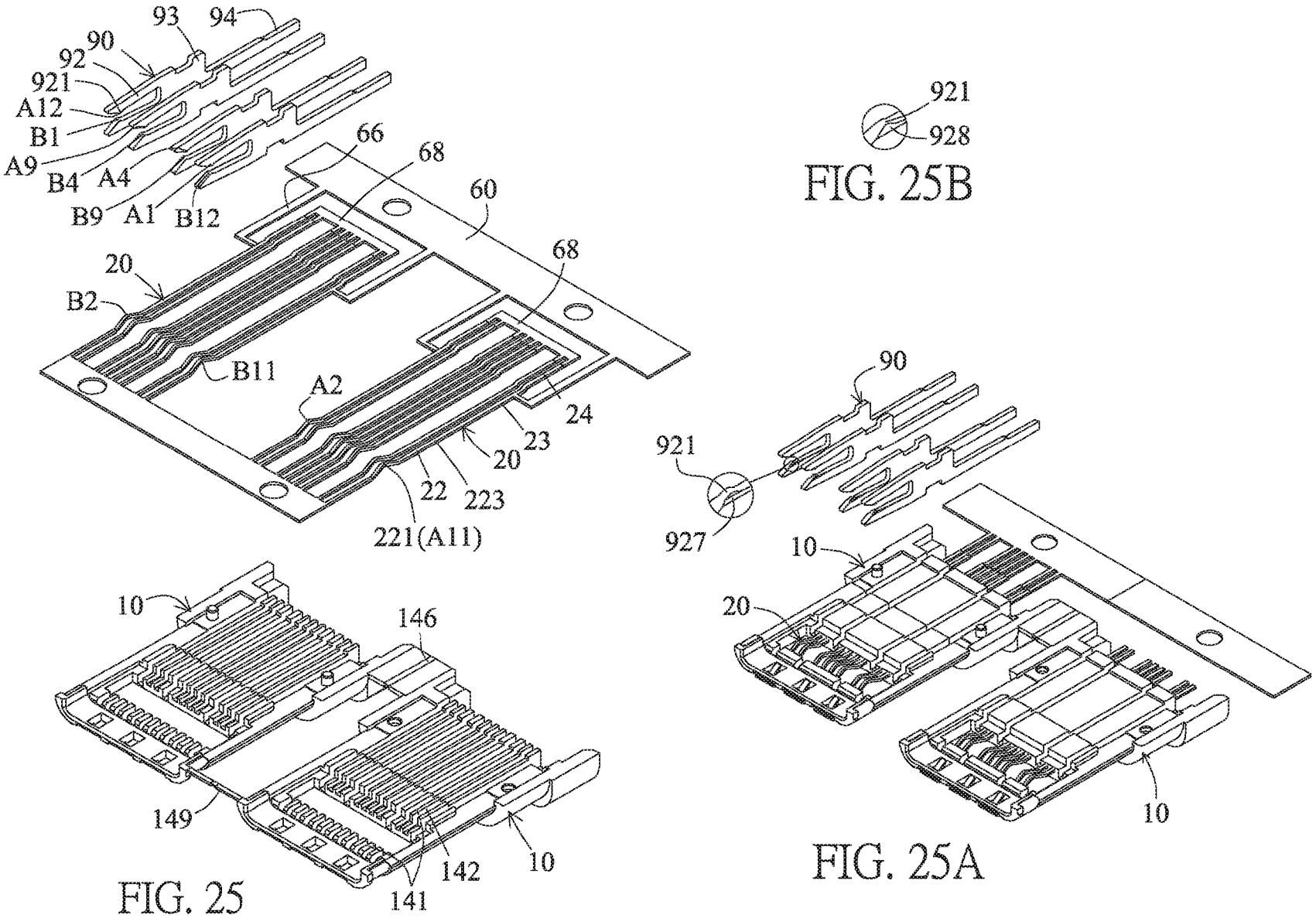
FIG. 25 is a pictorially exploded view showing the sixth modified implementation of the first embodiment of the invention.
FIG. 25A is a pictorially exploded view showing the seventh modified implementation of the first embodiment of the invention.
FIG. 25B is a partial pictorial view showing the seventh modified implementation of the first embodiment of the invention.

Referring to FIG. 25, the sixth modified implementation of the first embodiment of the invention is substantially the same as the first embodiment except for the difference that the front ends of the two insulation seats 10 are provided with another plastic material bridge 149, the material tape 60 is provided with two material bridges 66 connected to two side terminals of the two rows of terminals 20, and the pins 24 of the two rows of terminals 20 are further connected to a sub-material tape 68.

Referring to FIG. 25A, the seventh modified implementation of the first embodiment of the invention is substantially the same as the first embodiment except for the difference that two sides of each of the contacts 921 of one row of terminals 90 of this modified implementation are provided with chamfers 927, so that the area of the contact 921 is decreased to satisfy that specified by USB Association.

Referring to FIG. 25B, two sides of each of the contacts 921 of the one row of terminals 90 may also have thinned structures 928, so that the area of the contact 921 is decreased to satisfy that specified by USB Association.

Figure 26:
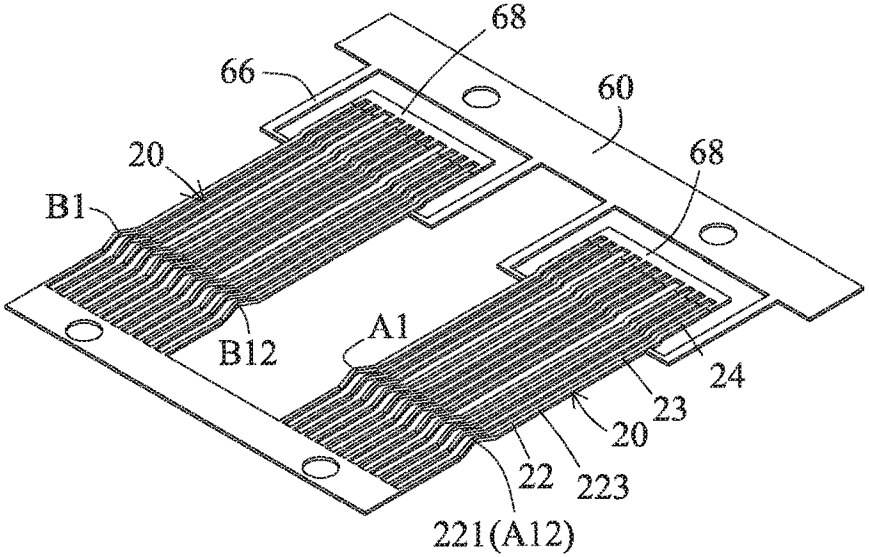
FIG. 26 is a pictorially exploded view showing the eighth modified implementation of the first embodiment of the invention.
Figure 26:
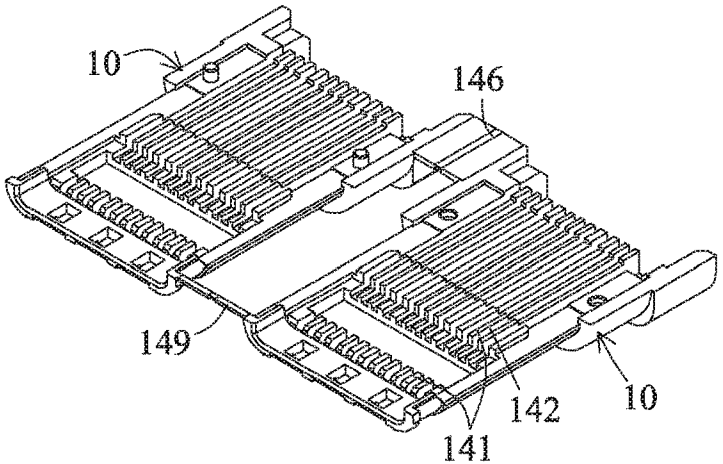

Referring to FIG. 26, the eighth modified implementation of the first embodiment of the invention is substantially the same as the fourth and sixth modified implementations except for the difference that the front ends of the two insulation seats 10 are provided with another plastic material bridge 149.

Figure 27:
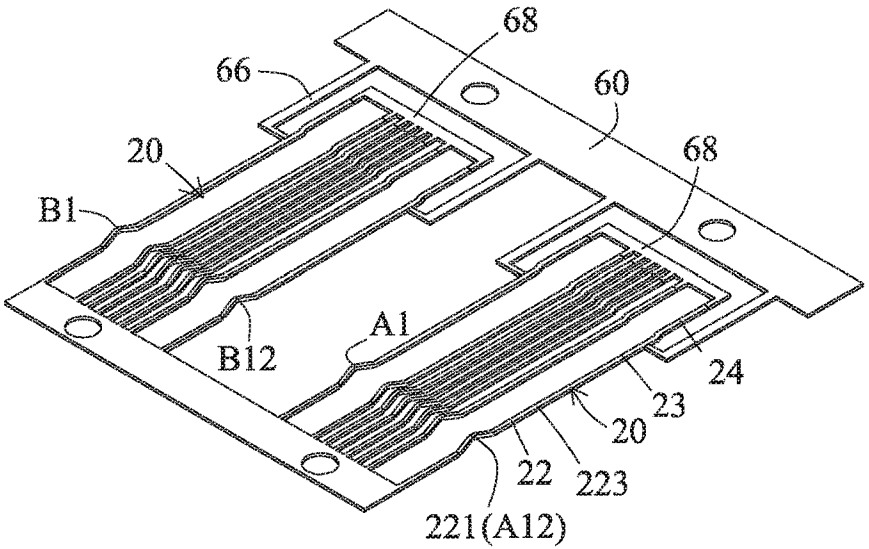
FIG. 27 is a pictorially exploded view showing the ninth modified implementation of the first embodiment of the invention.
Figure 27:
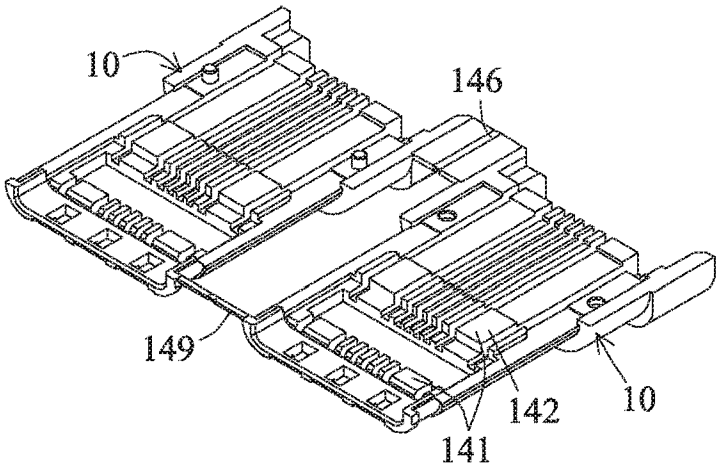

Referring to FIG. 27, the ninth modified implementation of the first embodiment of the invention is substantially the same as the eighth modified implementation except for the difference that this embodiment is a bidirectional duplex USB TYPE-C 2.0 electrical plug.

Referring to FIGS. 28 to 33, the second embodiment of the invention provides a bidirectional duplex USB TYPE-C 3.0 electrical plug, which is provided with two insulation seats 10, two rows of terminals 20, a metal partition plate 30, two ground members 40 and a metal housing 50, and is substantially the same as the seventh modified implementation of the first embodiment except for the difference that each of the fixing portions 23 of the two side terminals of the two rows of terminals 20 is connected to a L-shaped material sheet 201. The four L-shaped material sheets 201 are connected to four material bridges 66 of the material tape 60, wherein the two material bridges 66 connecting the lower row of terminals 20 have the wider widths, each of two sides of the rear end of the seat 10 thereabove is provided with one side plate 150 to function to position the width of a circuit board.

Figures 28, 29:
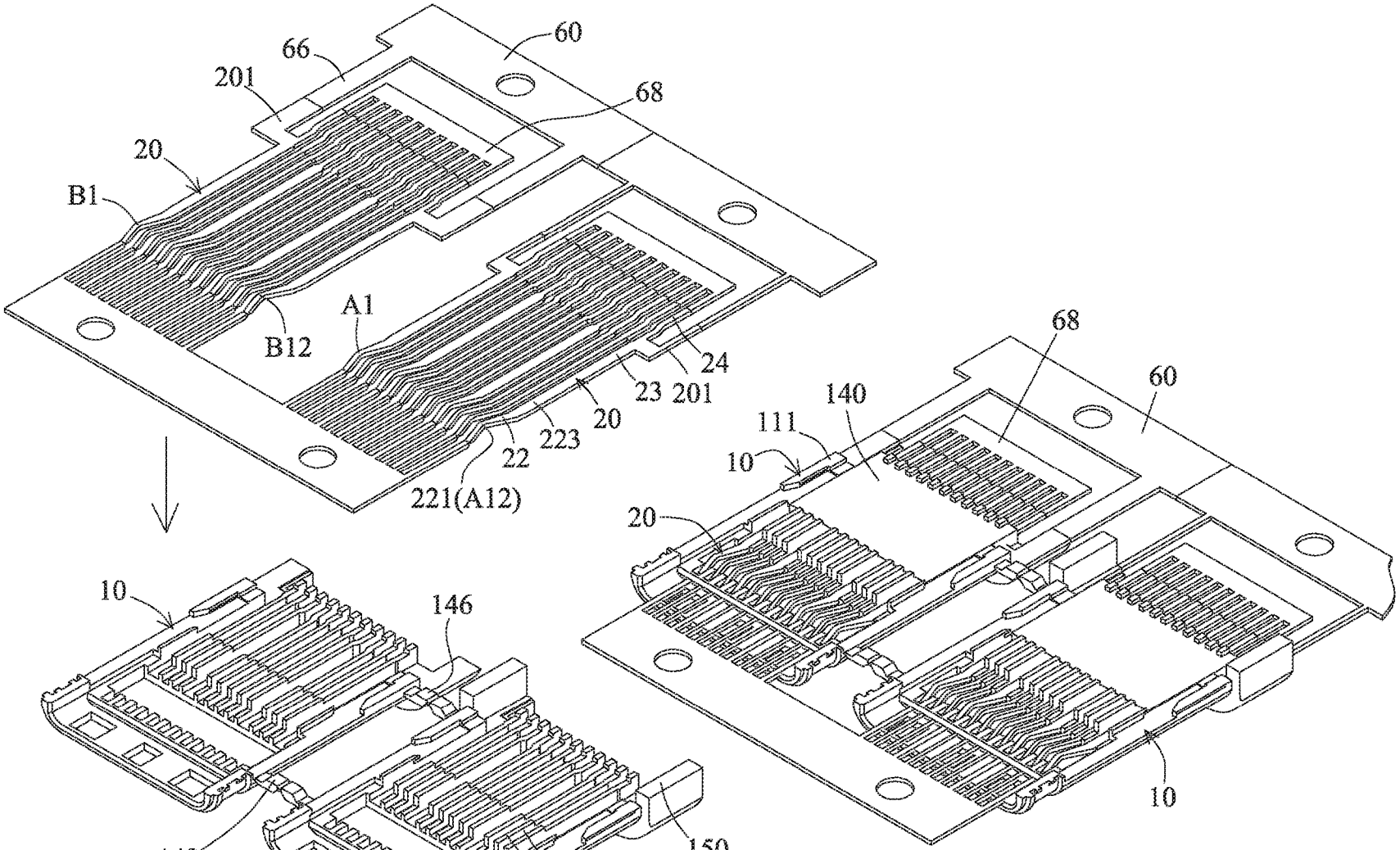
FIG. 28 is a pictorial view showing the manufacturing process according to the second embodiment of the invention.
FIG. 29 is a pictorial view showing the manufacturing process according to the second embodiment of the invention.

The method of manufacturing this embodiment will be described in the following. Referring to FIG. 28, the two rows of terminals 20 are provided. The two rows of terminals 20 are formed by stamping the same metal sheet and are arranged adjacently. In addition, each of the fixing portions 23 of the two side terminals of the two rows of terminals 20 is connected to a L-shaped material sheet 201. The four L-shaped material sheets 201 are connected to four material bridges 66 of the material tape 60. The two material bridges 66 connecting the lower row of terminals 20 have the wider width. The pins 24 of the two rows of terminals 20 are further connected to a sub-material tape 68. The sub-material tape 68 is separated from the material tape 60 and disposed within the material tape 60. The two rows of terminals 20 have the connection points with the same circuit serial numbers arranged sequentially and in the same direction. In addition, the two insulation seats 10 are provided. The two insulation seats 10 are integrally plastic injection molded. Front and rear sections of one side of the base portion 11 of each of the two insulation seats 20 are integrally provided with plastic material bridges 146 and 149 mutually connected together.

Referring to FIG. 29, the two rows of terminals 20 are then assembled into the two rows of terminal slots 142 of the two insulation seats 10 in the up-down direction. The rear sections 223 of the elastically movable portions and the fixing portions 23 of the two rows of terminals 20 are on the same level and rest against the bottom surfaces of the two rows of terminal slots 142 of the two insulation seats 10. The depth of the terminal slot 142 is greater than the material thickness of the terminal 20, so that the rear section 223 of the elastically movable portion and the fixing portion 23 fall into the terminal slot 142. The encapsulant is then provided at the position corresponding to the fixing portion 23 by way of secondary processing to form the fixing structure 140, wherein the fixing portion 140 covers the fixing portions 23 of the one row of terminals 20 and is in the form of a plane slightly depressed from the connection surface 111.

Figure 30:
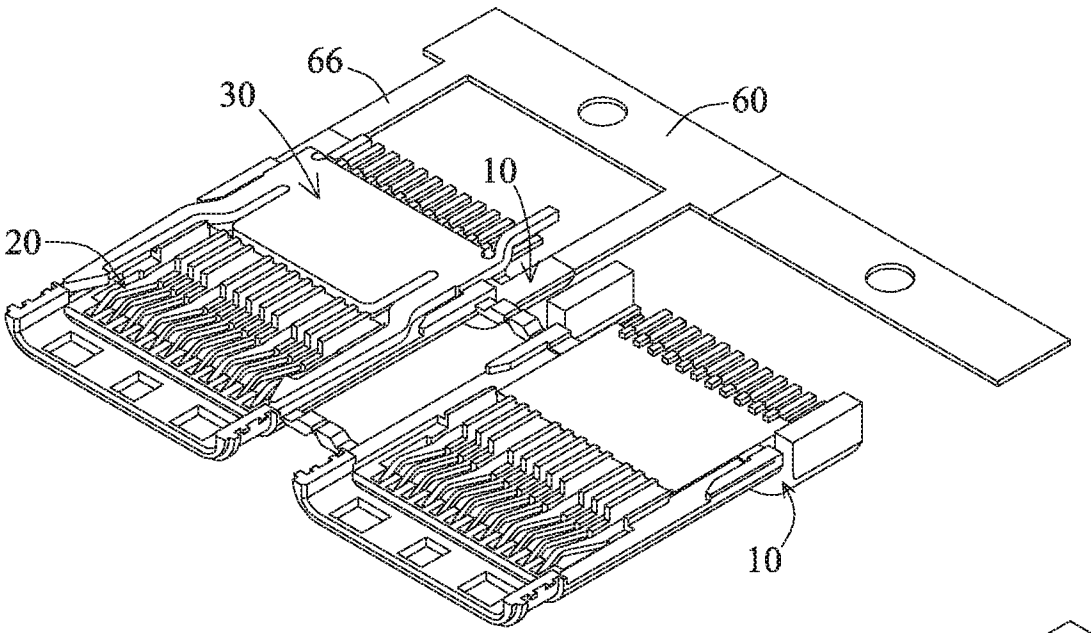
FIG. 30 is a pictorial view showing the manufacturing process according to the second embodiment of the invention.

Referring to FIG. 30, the metal partition plate 30 is then provided and placed on the fixing structure 140 of one insulation seat 10, the material tape 60 on the front ends of the two rows of terminals is cut off, and the two sub-material tapes 60 and the two narrower material bridges 66 are cut off. At this time, the two insulation seats 10 are connected to the material tape 60 only through the two wider material bridges 66.

Figure 31:
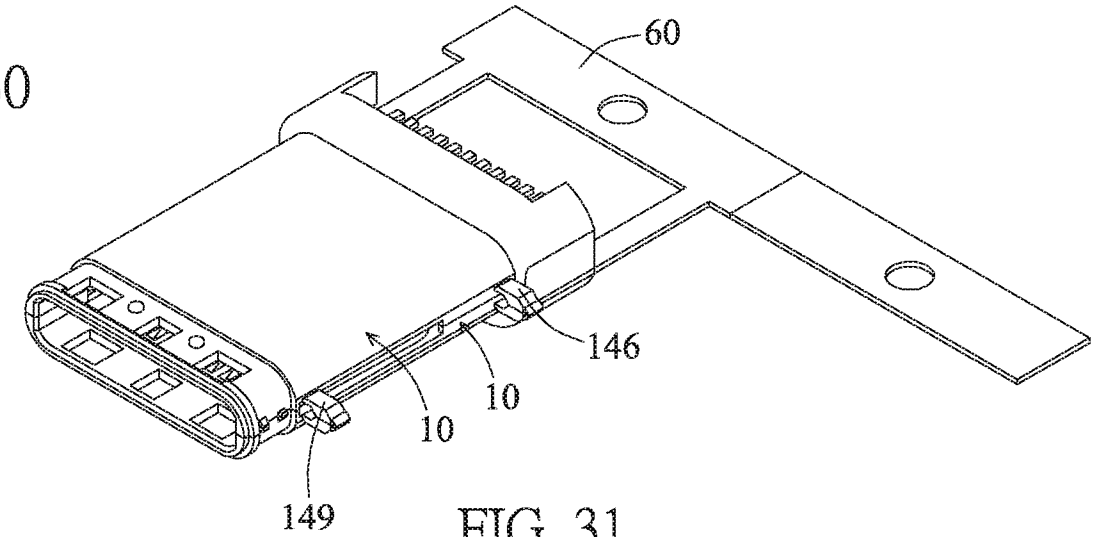
FIG. 31 is a pictorial view showing the manufacturing process according to the second embodiment of the invention.

Referring to FIG. 31, the insulation seat 10 is then separated from the material tape flipped by 180 degrees and stacked over the other insulation seat 10, and the two insulation seats 10 are stacked in an up-down direction. At this time, two rows of terminals 20 having the connection points with the same circuit serial numbers are arranged reversely in order.

Figure 32:
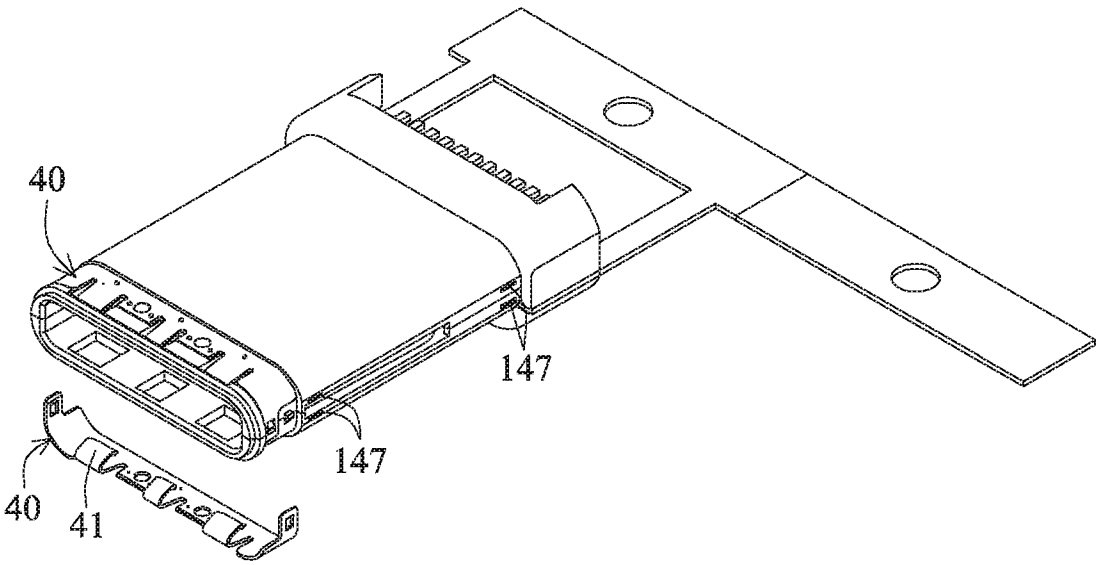
FIG. 32 is a pictorial view showing the manufacturing process according to the second embodiment of the invention.

Referring to FIG. 32, the plastic material bridges 146 and 149 on one side of the two insulation seats 10 are then cut off, and one side of each of the two insulation seats 10 is formed with a cut mark 147. At this time, two grounding sheets 40 are assembled on the front sections of the two insulation seats 10.

Figure 33:
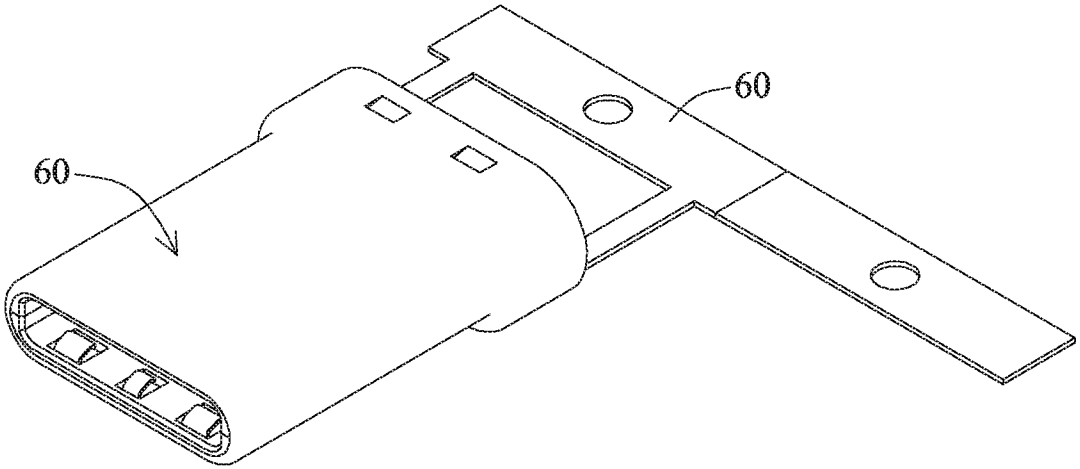
FIG. 33 is a pictorial view showing the manufacturing process according to the second embodiment of the invention.

Referring to FIG. 33, the metal housing 50 is assembled, from front to rear, to cover and be fixed to the two insulation seats 10, and finally the two material tapes 66 are cut off.

Figure 34:
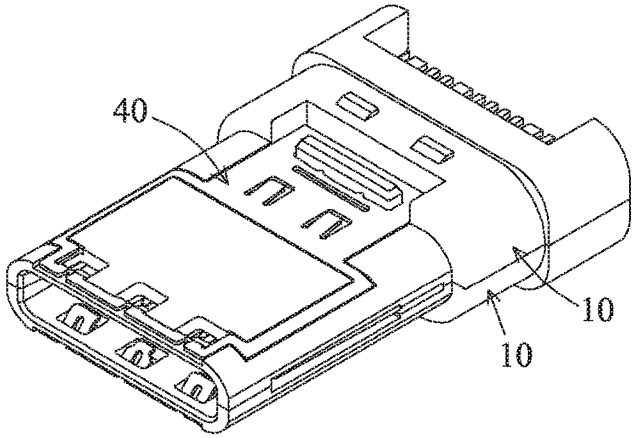
FIG. 34 is a pictorial view showing the first modified implementation of the second embodiment of the invention.
Figure 35:
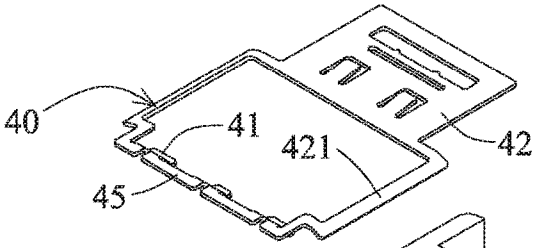
FIG. 35 is a pictorially exploded view showing the first modified implementation of the second embodiment of the invention.
Figure 35:
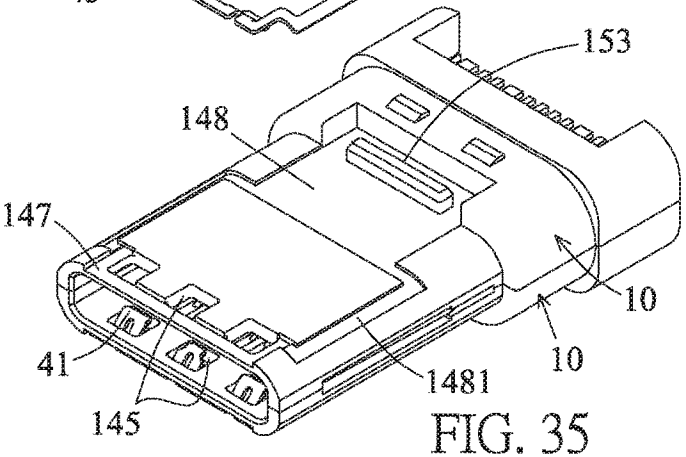
Figure 36:
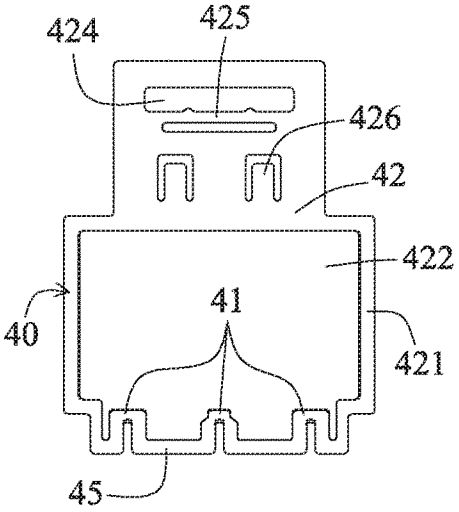
FIG. 36 is a top view showing the ground member according to the first modified implementation of the second embodiment of the invention.

Referring to FIGS. 34 to 36, the first modified implementation of the second embodiment of the invention is substantially the same as the second embodiment except for the difference that each of the outer surfaces of the two insulation seats 10 is provided with, from front to rear, a concave surface 147, a concave surface 148 and an engagement block 153. The concave surfaces 147 are more concave than the concave surface 148 and disposed on the front and two sides of the three through holes 145, the concave surface 148 is disposed on the rear section of the insulation seat 10, the concave surface 148 is provided with two side portions 1481 extending frontwards, the two side portions 1481 are disposed on the arced portions of two sides of the insulation seat 10 and connected to the concave surfaces 147, and the engagement block 153 is disposed on the rear section of the concave surface 148.

Each of the two ground members 40 is provided with a positioning sheet 42 and a twisting sheet 45 and three elastic sheets 41, the positioning sheet 42 is connected to and positioned at the concave surface 148 to form a substantial flush structure, the positioning sheet 42 is provided with a locking hole 424 and two resting elastic sheets 426, the locking hole 424 is a longitudinal hole extending in the left-right direction, the front end of the locking hole 424 is provided with a resilient member 425, the locking hole 424 can resiliently lock with the engagement block 153 through the resilient member 425, the two resting elastic sheets 426 projecting in the up-down direction can rest against the metal housing, two sides of the positioning sheet 42 extend frontward and are provided with two side portions 421, the front ends of the two side portions 421 are connected to the twisting sheet 45, the two side portions 421 and the twisting sheet 45 form a hollow region 422, the two side portions 421 are connected to the two side portions 1481 in an arced-surface-like manner, the twisting sheet 45 is placed on the concave surface 147, the thickness of the twisting sheet 45 is smaller than the depth of the concave surface 147, and the three elastic sheets 41 are connected to the twisting sheet 45 and extend backwards. The three elastic sheets 41 and the twisting sheet 45 are in the form of a plate sheet extending in an integrally continuous curved manner, so the three elastic sheets 41 are inverse-U shaped and project beyond the three openings 145 in the up-down direction. The concave surface 147 is more concave than the concave surface 148. So, after the two insulation seats 10 are fitted with the metal housing 50, the twisting sheet 45 can twist in the twisting gap of the concave surface 147, so that the resilience of the three elastic sheets 41 can be increased.

Figure 37:
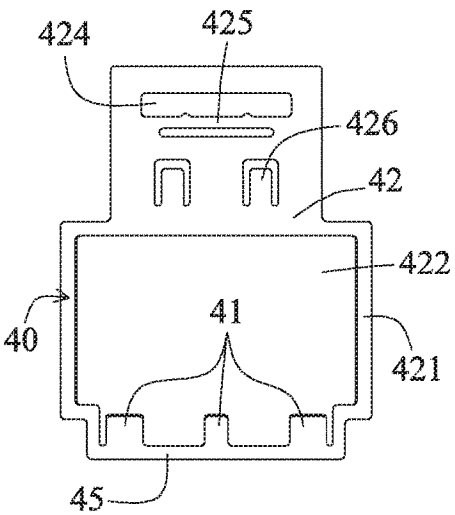
FIG. 37 is a top view showing the ground member according to the second modified implementation of the second embodiment of the invention.

Referring to FIG. 37, the second modified implementation of the second embodiment of the invention is substantially the same as the first modified implementation of the second embodiment except for the difference that the three elastic sheets 41 of the ground member 40 are not inverse-U shaped.

Figure 38:
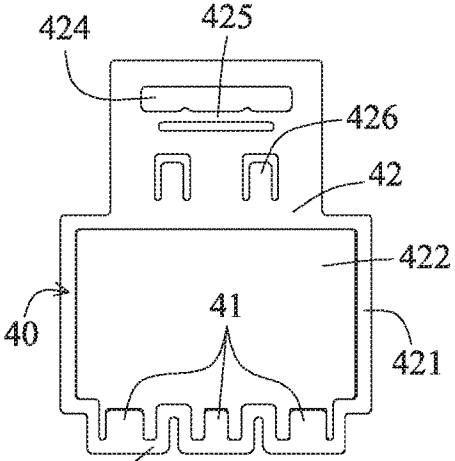
FIG. 38 is a top view showing the ground member according to the third modified implementation of the second embodiment of the invention.

Referring to FIG. 38, the third modified implementation of the second embodiment of the invention is substantially the same as the second modified implementation of the second embodiment except for the difference that the twisting sheet 45 of the ground member 40 is provided with two inverse-U shaped structures respectively disposed between two elastic sheets 41.

Figure 39:
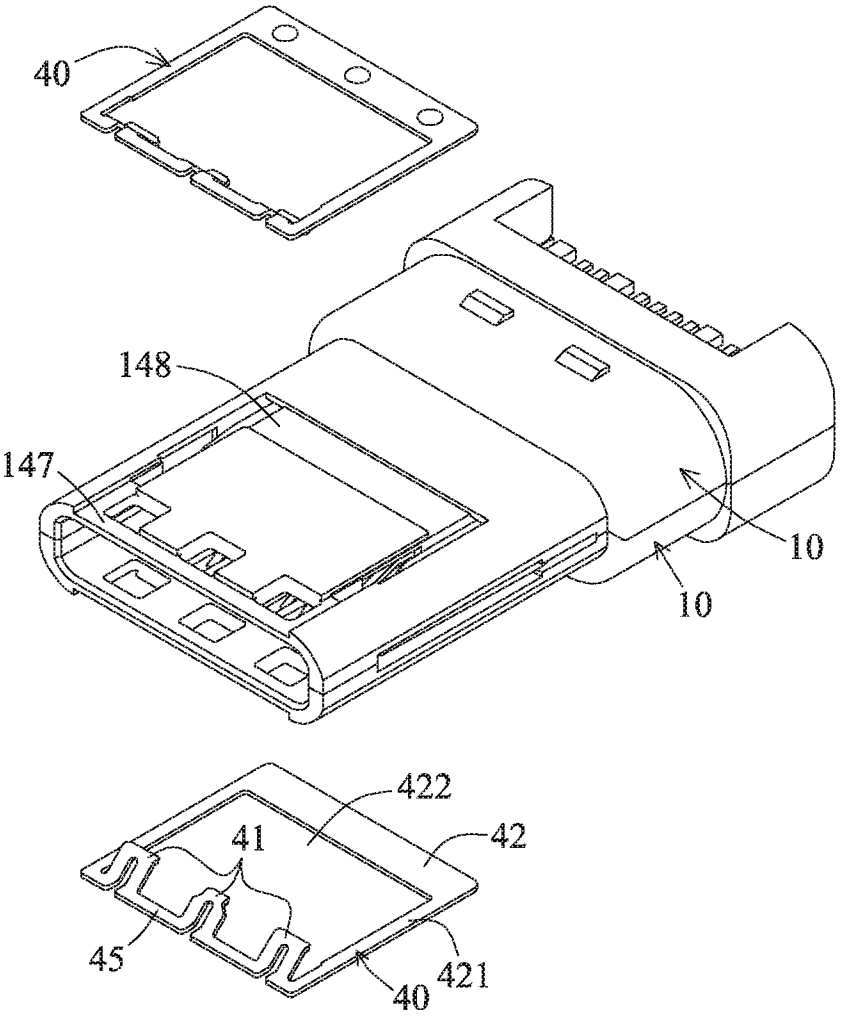
FIG. 39 is a pictorially exploded view showing the fourth modified implementation of the second embodiment of the invention.
Figure 42:
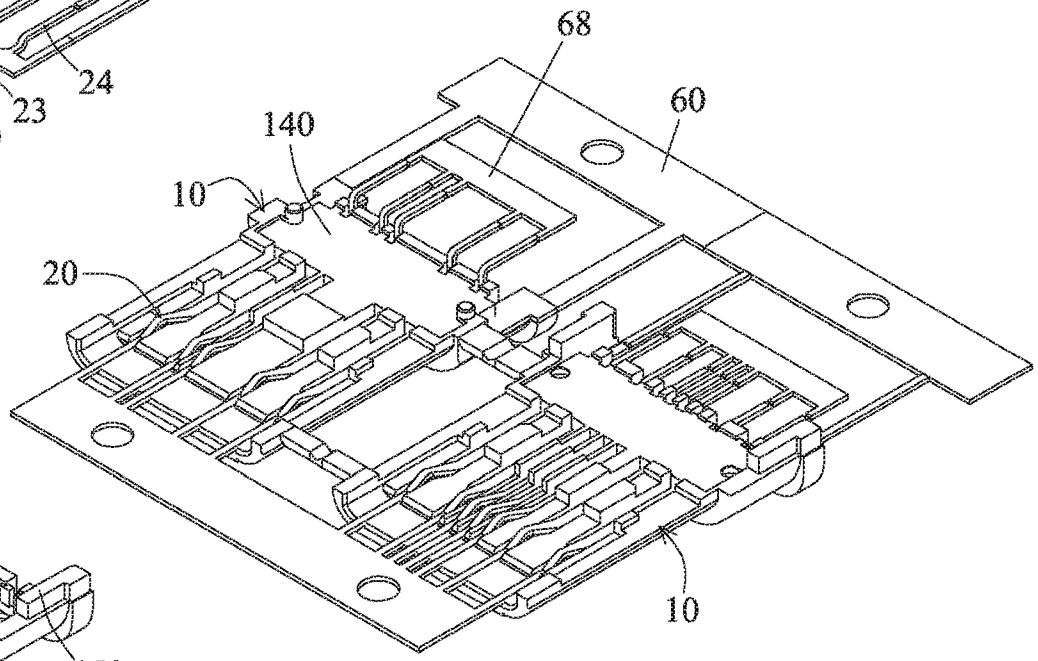
FIG. 42 is a pictorial view showing the manufacturing process according to the third embodiment of the invention.
Figure 41:
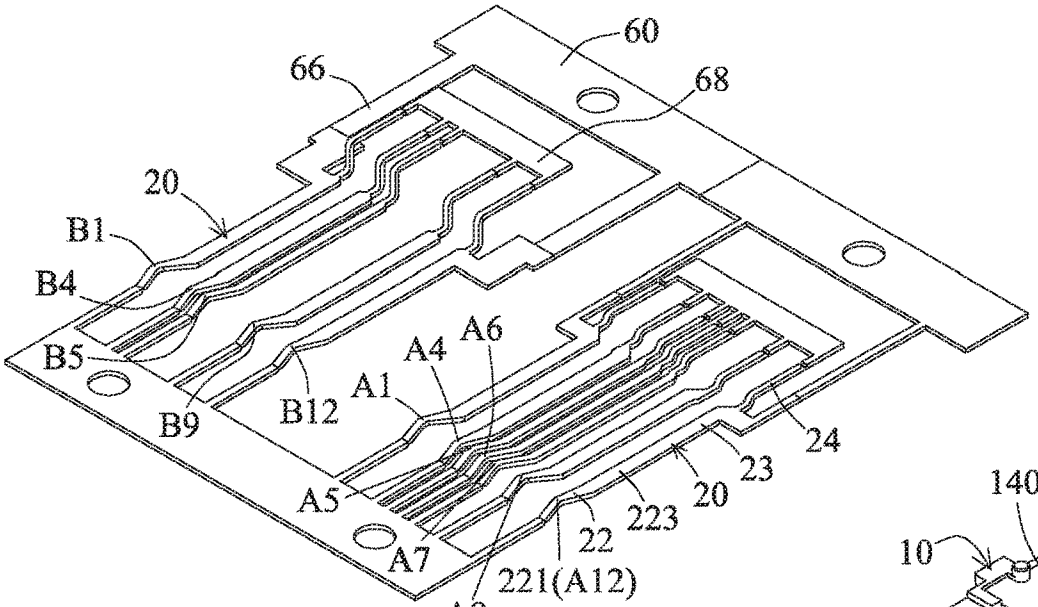
FIG. 41 is a pictorial view showing the manufacturing process according to the third embodiment of the invention.
Figure 41:
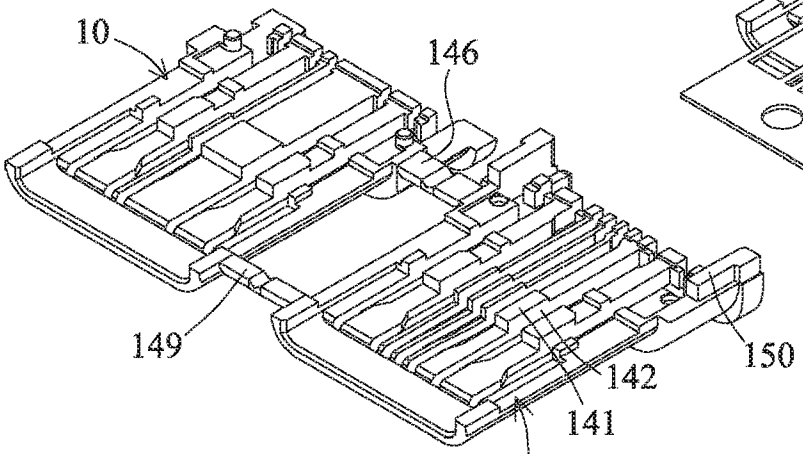
Figure 43:
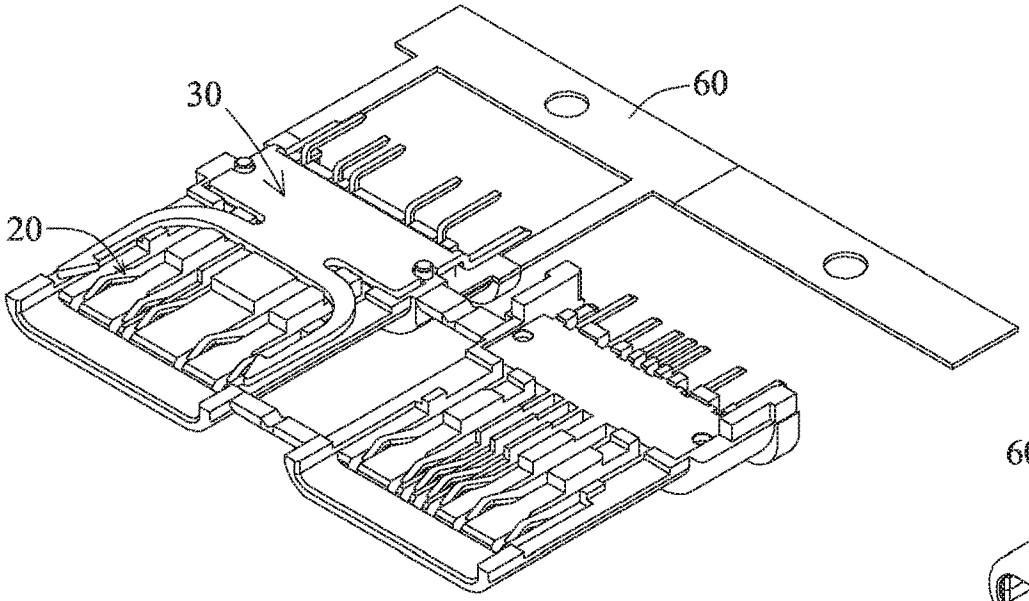
FIG. 43 is a pictorial view showing the manufacturing process according to the third embodiment of the invention.
Figure 45:
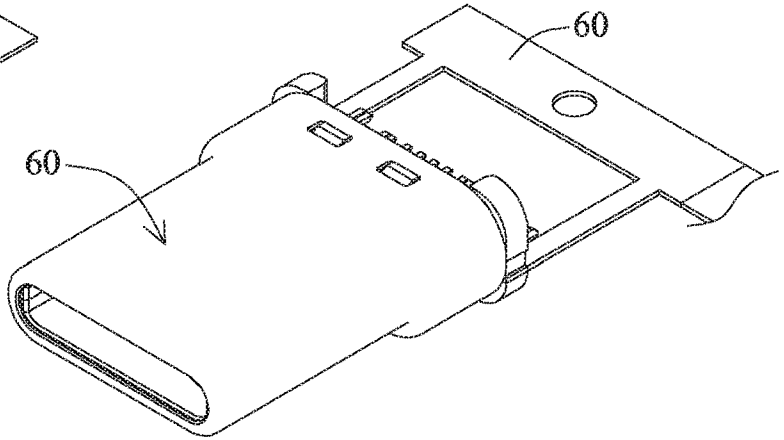
FIG. 45 is a pictorial view showing the manufacturing process according to the third embodiment of the invention.
Figure 44:
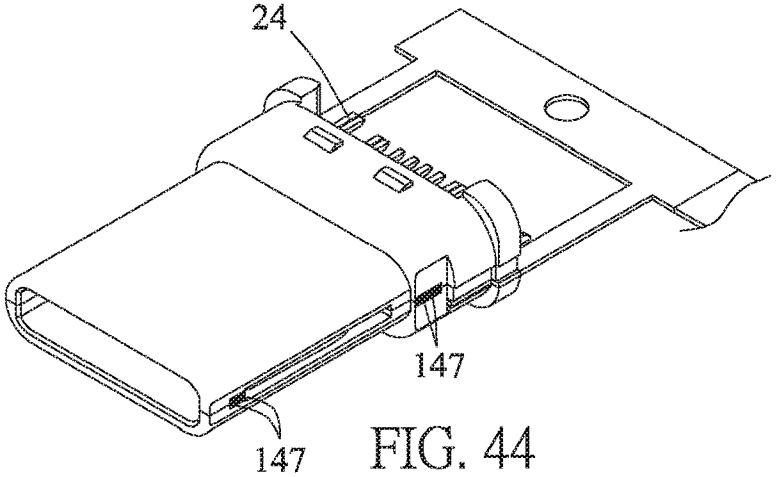
FIG. 44 is a pictorial view showing the manufacturing process according to the third embodiment of the invention.

Referring to FIG. 39, the fourth modified implementation of the second embodiment of the invention is substantially the same as the first modified implementation of the second embodiment except for the difference that two side portions 421 of the positioning sheet 42 of the ground member 40 are disposed on the inner side and in the forms of planes.

Figure 40:
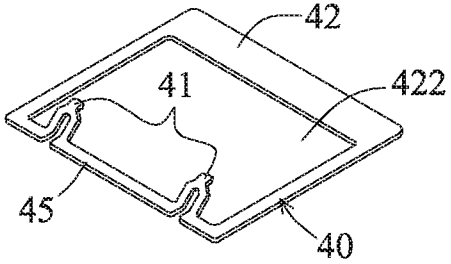
FIG. 40 is a pictorial view showing the fifth modified implementation of the second embodiment of the invention.

Referring to FIG. 40, the fifth modified implementation of the second embodiment of the invention is substantially the same as the fourth modified implementation of the second embodiment except for the difference that the ground member 40 only has two elastic sheets 41.

Referring to FIGS. 41 to 45 according to the third embodiment of the invention, this embodiment is a bidirectional duplex USB TYPE-C 2.0 electrical plug is substantially the same as the second embodiment except for the difference that the upper row of terminals 20 of this implementation have seven terminals A1, A4, A5, A6, A7, A9 and A12, and the lower row of terminals 20 have five terminals B1, B4, A5, B9 and B12.

The manufacturing method of this embodiment is substantially the same as the second embodiment except for the difference that this embodiment has no ground member, and the pins 24 of the upper and lower terminals 20 are in the form of one horizontal row of members flush with each other, wherein the pins 24 of the four pairs of terminals A1/B12, A4/B9, A9/B4 and A11/B1 are in an horizontal equal-height and parallel manner or adjacent and close to each other.

Referring to FIGS. 46 to 49 showing the first modified implementation of the third embodiment of the invention, this embodiment is a bidirectional duplex USB TYPE-C 2.0 electrical plug is substantially the same as the third embodiment except for the difference that the base portion 11 of the lower insulation seat 10 of this embodiment extends backwards and projects to form a bonding plate 114 as compared with the base portion of the upper insulation seat 10, wherein the bonding plate 114 is provided with one row of pin slots 115 and two U-shaped slots 116; the pins 24 of one pair of power terminals B4/B9 of the lower row of terminals 20 are integrally connected to a U-shaped connection sheet 208, the pins 24 of the one pair of ground terminals B1/B12 are integrally connected to a U-shaped connection sheet 208, the two U-shaped connection sheets 208 extend backwards and bypass the pin of the middle terminal and are in the form of a large U shape covering a small U shape, and the two U-shaped connection sheets 208 and the pins of the lower row of terminals have a height difference; and the pins 24 of the one pair of power terminals A4/A9 of the upper row of terminals 20 are integrally connected to a U-shaped connection sheet 208, the pins 24 of the one pair of ground terminals B1/B12 are integrally connected to a U-shaped connection sheet 208, the two U-shaped connection sheets 208 extend backwards and bypass the pin of the middle terminal and are in the form of a large U shape covering a small U shape, and the two U-shaped connection sheets 208 and the pins of the upper row of terminals have a height difference.

Figure 47:
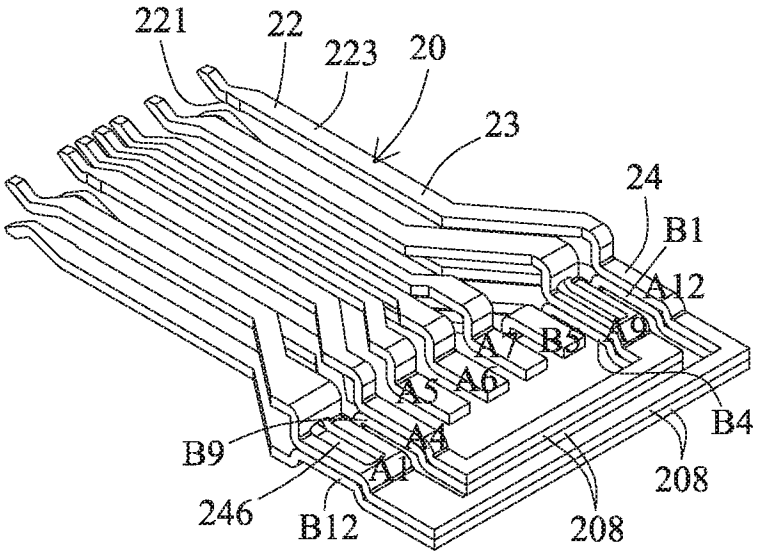
FIG. 47 is a pictorially assembled view showing two rows of terminals according to the first modified implementation of the third embodiment of the invention.
Figure 46:
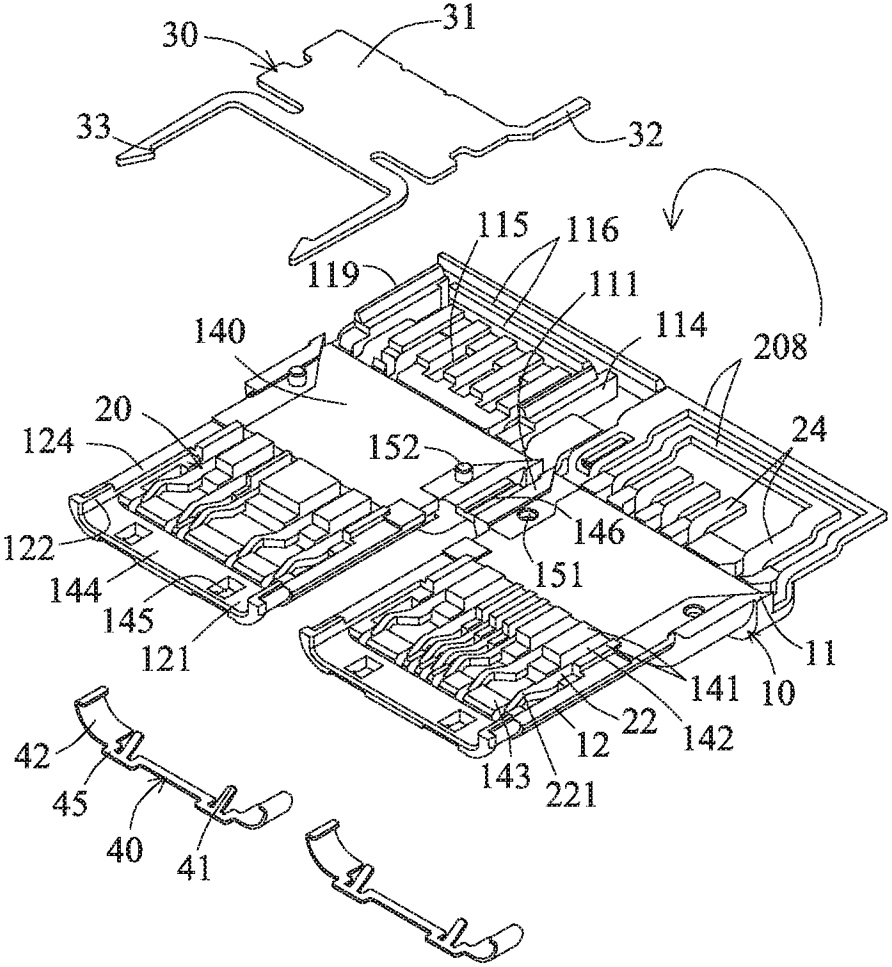
FIG. 46 is a pictorially exploded view showing the first modified implementation of the third embodiment of the invention.
Figure 49:
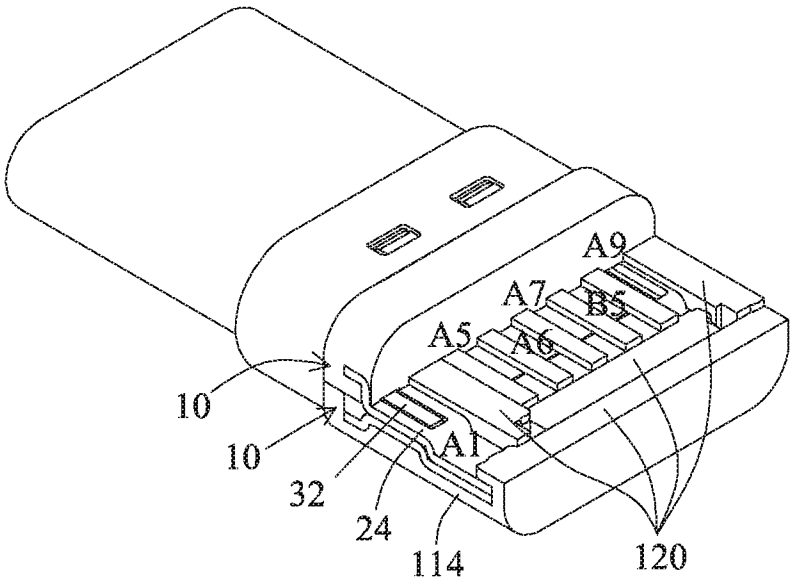
FIG. 49 is a pictorially assembled view showing the first modified implementation of the third embodiment of the invention after secondary processing.
Figure 48:
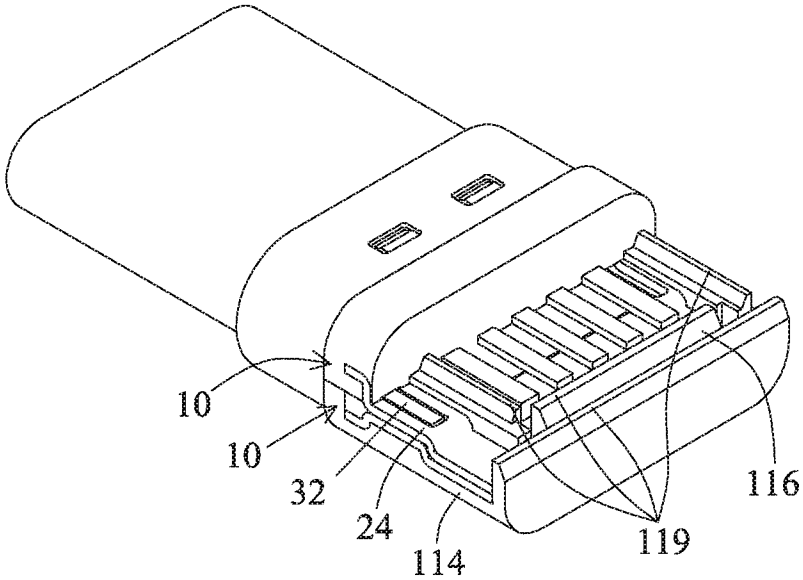
FIG. 48 is a pictorially assembled view showing the first modified implementation of the third embodiment of the invention before secondary processing.
Figure 52:
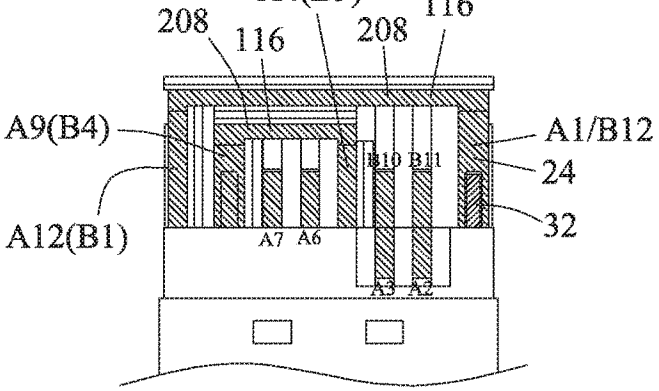
FIG. 52 is a top view showing the second modified implementation of the third embodiment of the invention before secondary processing.
Figure 53:
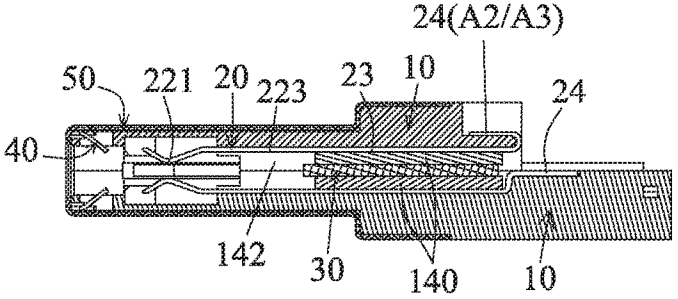
FIG. 53 is cross-sectional side view showing the implementation state of the second modified implementation of the third embodiment of the invention.
Figure 54:
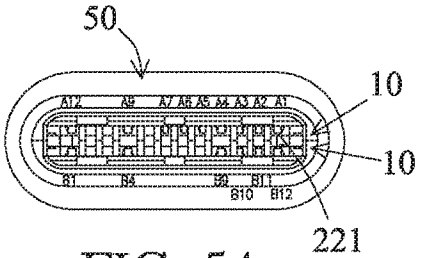
FIG. 54 is a front view showing the second modified implementation of the third embodiment of the invention.
Figure 50:
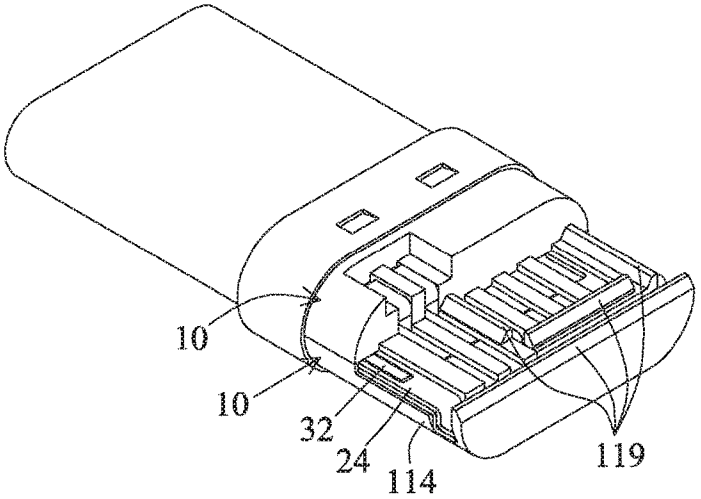
FIG. 50 is a pictorially assembled view showing the second modified implementation of the third embodiment of the invention before secondary processing.
Figure 51:
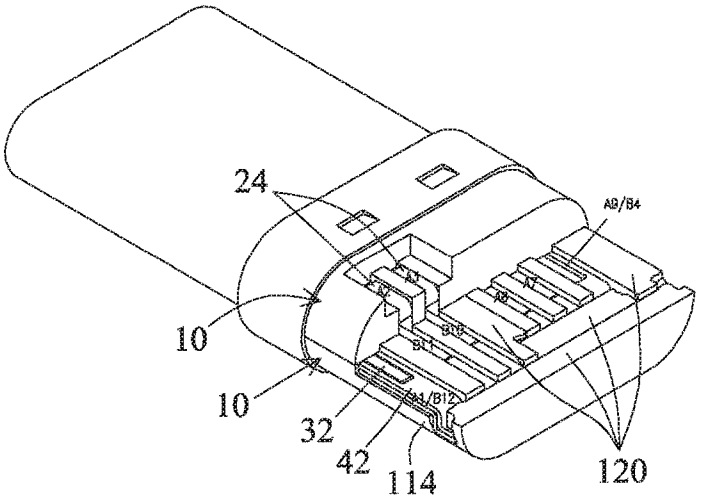
FIG. 51 is a pictorially assembled view showing the second modified implementation of the third embodiment of the invention after secondary processing.

Referring to FIG. 47 and FIG. 48, when the two insulation seats 10 are stacked in an up-down direction, the pins 24 of the two rows of terminals are in flat surface contact with and arranged in the one row of pin slots 115, wherein A1 and B12 aligned in an up-down direction are ground terminals, A12 and B1 are ground terminals, and A4 and B9 are power terminals. So, the pins 23 of the four pairs of terminals are stacked in an up-down direction and are arranged in the pin slots 115 of the bonding plate 114, and the two pairs of U-shaped connection sheets 208 of the two rows of terminals 20 are stacked and fall into the two U-shaped slots 116. In order to prevent the two pairs of stacked U-shaped connection sheets 208 from being exposed, the secondary processing is again performed to hot-melt several bumps 119 to form a cover surface 120 covering the pins 24 of the two U-shaped slots 116 and A4 and A12, as shown in FIG. 49, and only the six pins 24 of A1, A5, A6, A7, B5 and A9 are left. In addition, the plate surface of the pin 24 of A1 is provided with a through hole 246, and the pin 32 of the metal partition plate 30 is connected to the through hole 246.

Referring to FIGS. 50 to 54 showing the second modified implementation of the third embodiment of the invention, this embodiment provides a bidirectional duplex USB TYPE-C 3.0 electrical plug substantially the same as the first modified implementation of the third embodiment except for the difference that: this embodiment is additionally provided with two pairs of high differential signal terminals, that is, the upper row of terminals are added with A2 and A3, the lower row of terminals are added with B10 and B11, wherein the pins 24 of A2 and A3 are bent upward reversely to horizontally extend frontwards to staggered with the pins 24 of B10 and B11. In addition, B5 is removed from the lower row of terminals, and A4 and A5 of the upper row of terminals are bonded to a resistor for electrically connection, wherein A5 has no output pin, so that eight pins 24 of A1, B11, B10, A2, A3, A6, A7 and A9 are provided in this embodiment.

Figure 56:
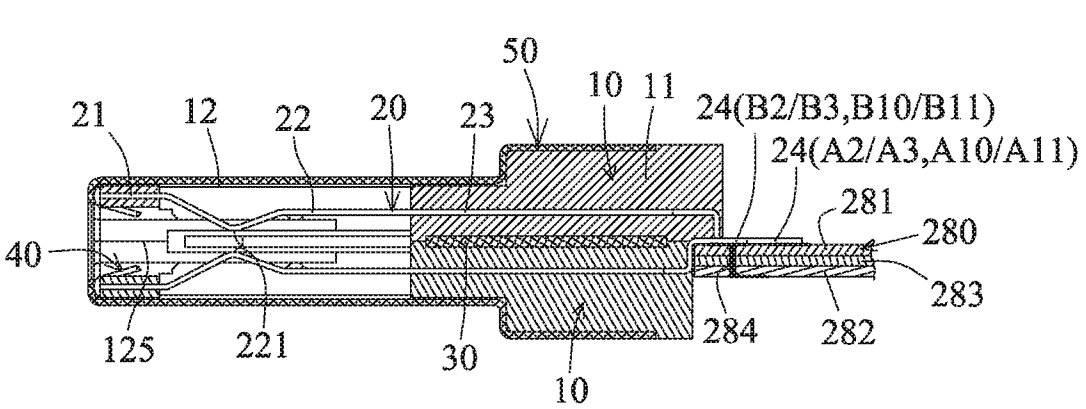
FIG. 56 is a cross-sectional side view showing the implementation state of the fourth embodiment of the invention.
Figure 55:
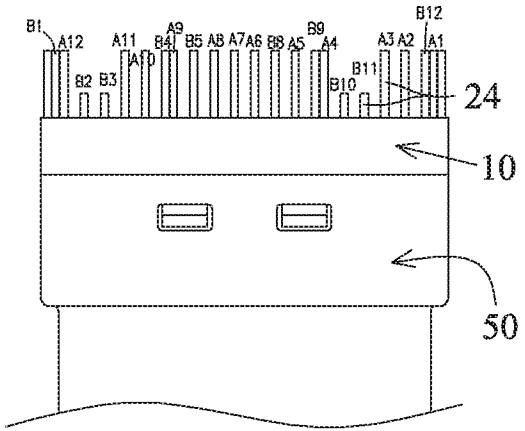
FIG. 55 is a top view showing the fourth embodiment of the invention.

Referring to FIGS. 55 and 56 according to the fourth embodiment of the invention, this embodiment provides a bidirectional duplex USB TYPE-C 3.0 electrical plug substantially the same as the first and second embodiments except for the difference that, in this embodiment, the horizontal sections of the pins 24 of the two pairs of high differential signal terminals (B2/B3, B10/B11) of the lower row of terminals are shorter than the horizontal sections of the pins 23 of the two pairs of high differential signal terminals (A2/A3, A10/A11) of the upper row of terminals. This implementation is electrically connected to a circuit board 280, which is a multi-layer board and provided with a metal layer 283. The bonding pads bonded to the pins 24 of the two pairs of high differential signal terminals (B2/B3, B10/B11) of the lower row of terminals are electrically connected to the other surface of the circuit board through vias 284, so that the two pairs of high differential signal terminals (B2/B3, B10/B11) and the two pairs of high differential signal terminals (A2/A3, A10/A11) respectively perform transmissions of the circuits on two sides of the circuit board 280, and the separation of the metal layer 283 can decrease the electromagnetic interference.

Figure 58:
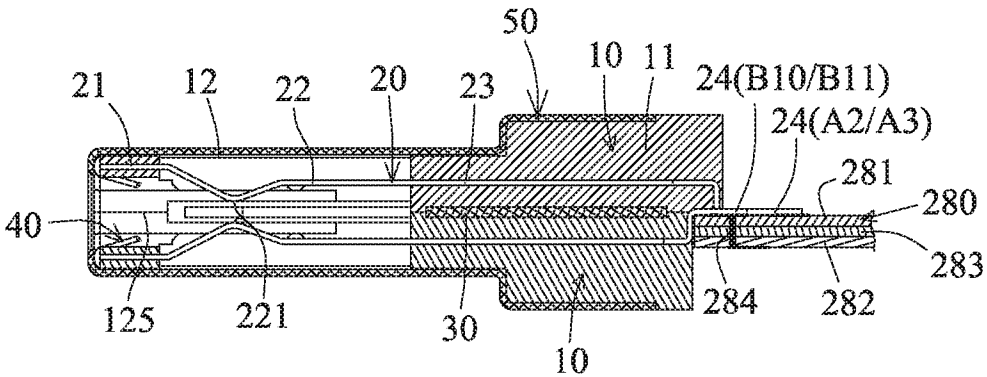
FIG. 58 is a cross-sectional side view showing the implementation state of the first modified implementation of the fourth embodiment of the invention.
Figure 57:
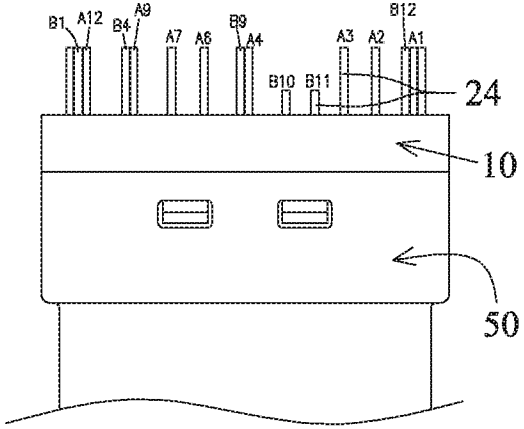
FIG. 57 is a top view showing the first modified implementation of the fourth embodiment of the invention.

Referring to FIGS. 57 and 58 showing the first modified implementation of the fourth embodiment of the invention, this embodiment provides a bidirectional duplex USB TYPE-C 3.0 electrical plug substantially the same as the first modified implementation of the fourth embodiment except for the difference that, in this embodiment, the horizontal sections of the pins 24 of only one pair of high differential signal terminals (B10/B11) of the lower row of terminals are shorter than the horizontal sections of the pins 23 of only one pair of high differential signal terminals (A2/A3) of the upper row of terminals.

Figure 59:
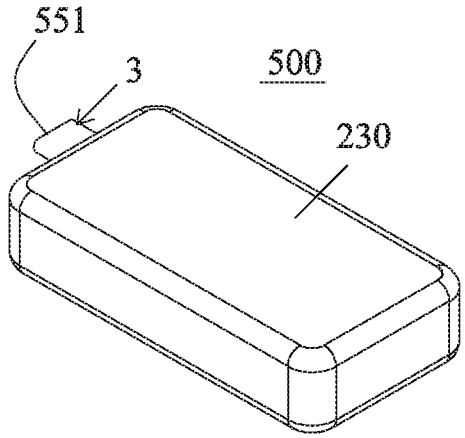
FIG. 59 is a pictorial view showing the fifth embodiment of the invention.
Figure 60:
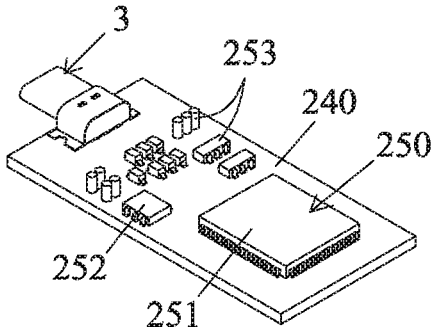
FIG. 60 is a pictorial view showing the fifth embodiment of the invention when the outer housing is not assembled.

Referring to FIGS. 59 and 60 according to the fifth embodiment of the invention, this embodiment provides a flash drive 500 having the electrical connector of the invention. The flash drive 500 includes an outer housing 230, a circuit board 240, an electronic device 250 and an electrical connector 3.

The circuit board 240 is provided with multiple electroconductive connection points and multiple printed circuits (not shown).

The electronic device 250 is electrically connected to the circuit board 240. The electronic device 250 includes an electronic unit 251, a control chip 252 and a circuit safety protection device 253. The electronic unit 251 is the main configuration of the electronic device 250, and is a storage unit, which may be a memory, in this embodiment.

The control chip 252 controls the operation of the electronic unit 251. The circuit safety protection device 253 includes multiple circuit safety protection elements, such as the power safety control chip, anti-over-current element, anti-over-voltage element, anti-short-circuit element, resistor, capacitor and the like. the power safety control chip can provide the following protection including the input high-voltage protection, input anti-reverse protection, output over-current protection, output over-voltage protection, output short-circuit protection, battery over-charge and over-discharge protection, battery PTC protection and charge/discharge temperature protection.

The electrical connector 3 is a bidirectional duplex USB TYPE-C 2.0/3.0/3.1 electrical plug having the structure the same as that of each of the first to fourth embodiments. The electrical connector 3 is electrically connected to the circuit board 240 and electrically connected to the electronic device 250.

The outer housing 230 covers the circuit board 240, the electronic device 250, and the rear section of the electrical connector 3. The front section of the electrical connector 3 and the insert port 551 of the connection slot are exposed from the outer housing 230.

Figure 61:
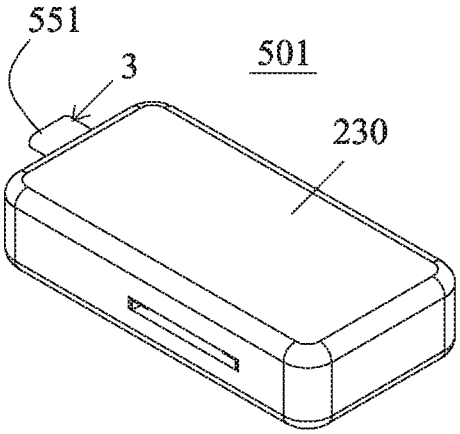
FIG. 61 is a pictorial view showing the sixth embodiment of the invention.
Figure 62:
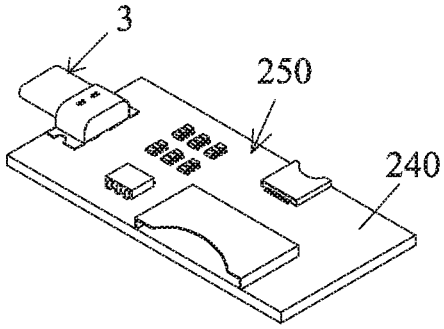
FIG. 62 is a pictorial view showing the sixth embodiment of the invention when the outer housing is not assembled.

Referring to FIGS. 61 and 62 according to the sixth embodiment of the invention, this embodiment provides a card reader 501 having the electrical connector of the invention and including an outer housing 230, a circuit board 240, an electronic device 250, and an electrical connector 3, and is substantially the same as the fifth embodiment, and detailed descriptions thereof will be omitted. The main difference resides in that the electronic unit of the electronic device 250 is an electronic combination of the card reader.

Figure 63:
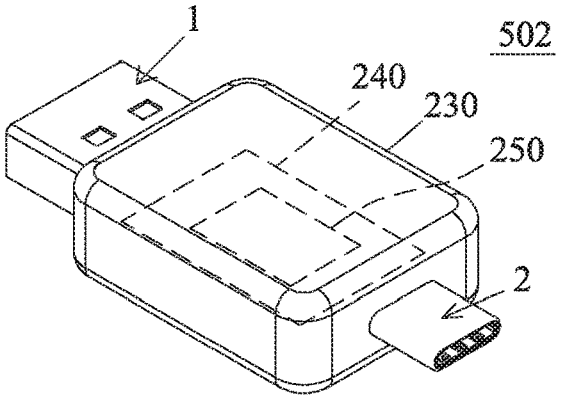
FIG. 63 is a pictorial view showing the seventh embodiment of the invention.

Referring to FIG. 63 according to the seventh embodiment of the invention, this embodiment provides an adapted electrical connector 502 having the electrical connector of the invention and including an adapter circuit, a first electrical connector 1, a second electrical connector 2 and an outer housing 230, wherein the adapter circuit is disposed on a circuit board 240, the first electrical connector 1 is disposed on one side of the circuit board 240, the second electrical connector 2 is disposed on the other side of the circuit board 240, one end of the adapter circuit is electrically connected to the first electrical connector 1, and the other end of the adapter circuit is electrically connected to the second electrical connector 2. Using the adapter circuit can adapt a first electrical connector 1 to three second electrical connectors 2, wherein the first electrical connector 1 is a USB A-type 2.0/3.0/3.1 connector, and the second electrical connector 2 is a bidirectional duplex USB TYPE-C 2.0/3.0/3.1 electrical plug having the structure the same as the structure of each of the first to fourth embodiments. The outer housing 230 covers the circuit board 240, the insert ports of the connection slots of the first electrical connector 1 and the second electrical connector 2 are exposed from the outer housing 230.

In addition, the circuit board 240 is electrically connected to and provided with an electronic device 250, the electronic device 250 includes an electronic unit, a control chip and a circuit safety protection device, the electronic unit is an electronic combination of an adapter device, and the electronic unit can perform switching and adapting on different interfaces, so that the first electrical connector 1 and the second electrical connector 2 having different interfaces can perform mutual adapting. The control chip controls the operation of the electronic unit. The circuit safety protection device includes multiple circuit safety protection elements, such as the power safety control chip, anti-over-current element, anti-over-voltage element, anti-short-circuit element, resistor, capacitor and the like.

Figure 64:
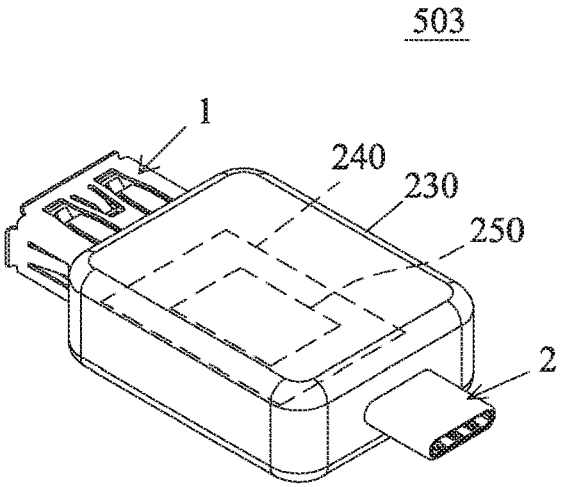
FIG. 64 is a pictorial view showing the eighth embodiment of the invention.

Referring to FIG. 64 according to the eighth embodiment of the invention, this embodiment provides an adapted electrical connector 503 having the electrical connector of the invention and is substantially the same as the seventh embodiment except for the difference that the first electrical connector 1 of this embodiment is a USB A-type 2.0/3.0/3.1 socket.

Figure 65:
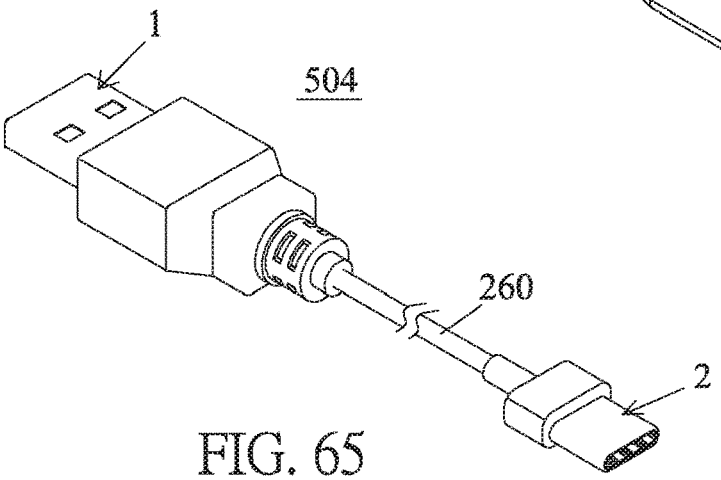
FIG. 65 is a pictorial view showing to the ninth embodiment of the invention.

Referring to FIG. 65 according to the ninth embodiment of the invention, this embodiment provides an adapted electrical connector 504 having the electrical connector of the invention and including an adapter circuit, a first electrical connector 1 and a second electrical connector 2, wherein the adapter circuit is an electrical connection cable 260, one end of the adapter circuit is electrically connected to the first electrical connector 1, and the end of the adapter circuit is electrically connected to the two second electrical connectors 2. Using the adapter circuit can adapt a first electrical connector 1 to two second electrical connectors 2, wherein the first electrical connector 1 is a USB A-type 2.0/3.0/3.1 connector, the two second electrical connectors 2 are bidirectional duplex USB TYPE-C 2.0/3.0/3.1 electrical plugs each having the structure the same as the structure of each of the first to fifth embodiments.

Figure 66:
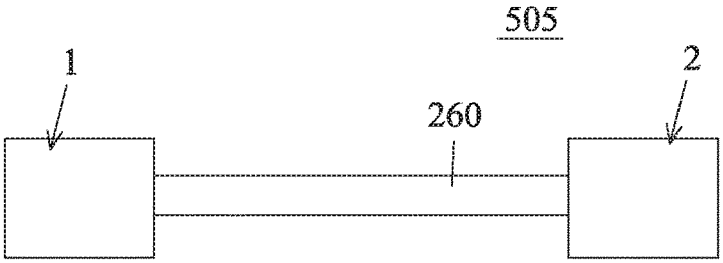
FIG. 66 is a schematic plane view showing the tenth embodiment of the invention.

Referring to FIG. 66 according to the tenth embodiment of the invention, this embodiment provides an adapted electrical connector 505 having the electrical connector of the invention, and is substantially the same as the ninth embodiment except for the difference that the second electrical connector 2 of this embodiment is a bidirectional duplex USB TYPE-C 2.0/3.0/3.1 electrical plug having the structure the same as the structure of each of the first to fourth embodiments. The first electrical connector 1 may be the D-SUB connector or socket, HDMI, Display Port, eSATA, RJ connector, network cable connector, memory card seat (e.g., SD memory card seat), chip smart card seat, or various electronic connectors or sockets.

Figure 67:
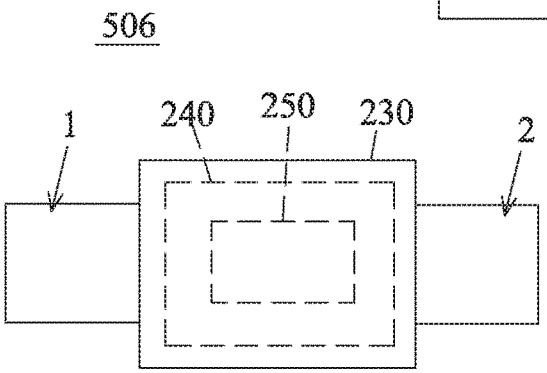
FIG. 67 is a schematic plane view showing the eleventh embodiment of the invention.

Referring to FIG. 67 according to the eleventh embodiment of the invention, this embodiment provides an adapted electrical connector 506 having the electrical connector of the invention and is substantially the same as the seventh embodiment except for the difference that the second electrical connector 2 of this embodiment is a bidirectional duplex USB TYPE-C 2.0/3.0/3.1 electrical plug having the structure the same as the structure of each of the first to fourth embodiments. The first electrical connector 1 may be the D-SUB connector or socket, HDMI, Display Port, eSATA, RJ connector, network cable connector, memory card seat (e.g., SD memory card seat), chip smart card seat, or various electronic connectors or sockets.

Figure 68:
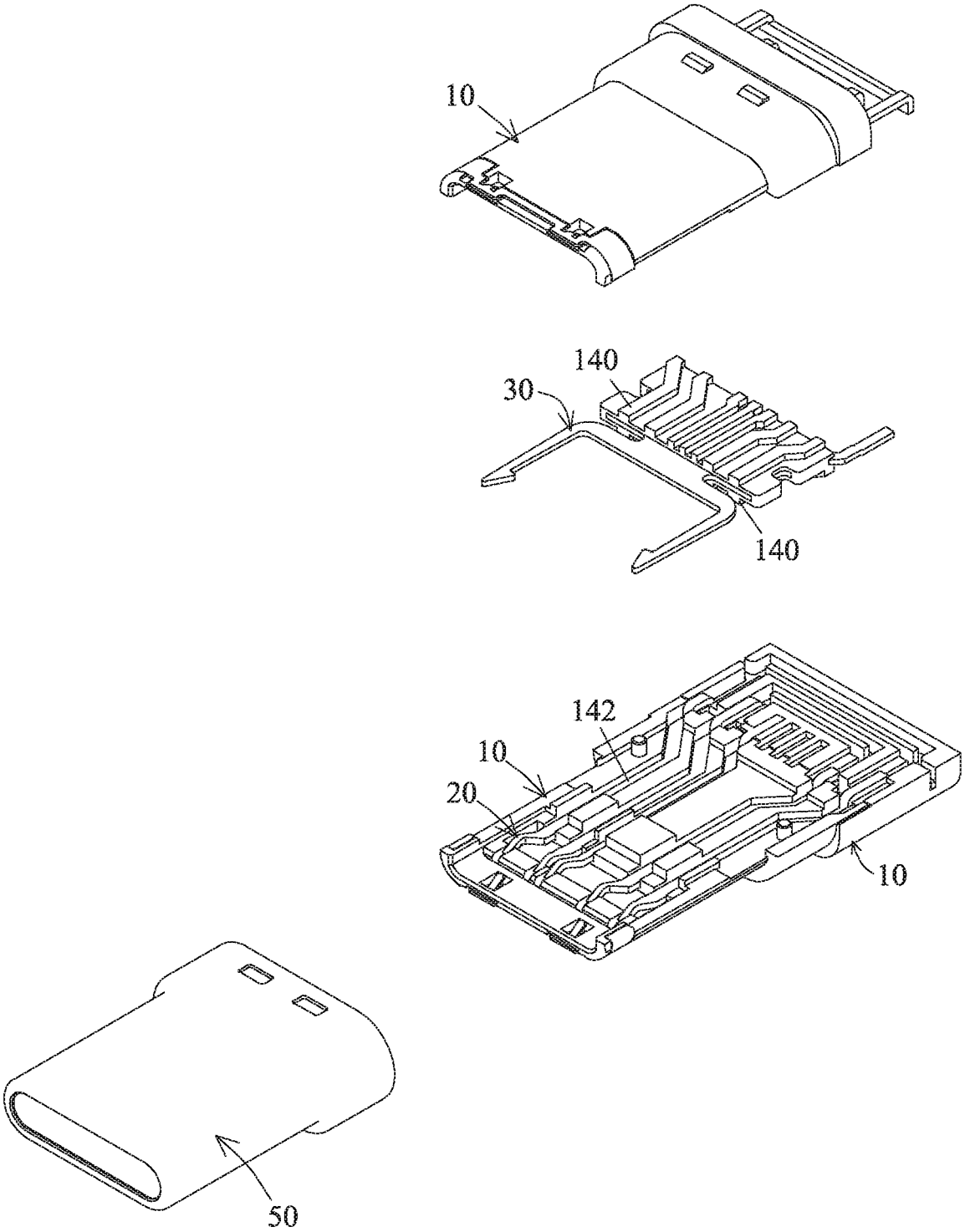
FIG. 68 is a pictorially exploded view showing the twelfth embodiment of the invention.

Referring to FIG. 68 according to the twelfth embodiment of the invention, this embodiment provides a bidirectional duplex USB TYPE-C 2.0 electrical plug substantially the same as the first modified implementation of the third embodiment and the fourth modified implementation of the first embodiment. Similarly, this embodiment has the top and bottom surfaces of the metal partition plate 30 embedded into and plastic injection molded with the fixing structure 140, wherein the fixing structure 140 is filled into the terminal slots 142 to fix each terminal.

Figure 69:
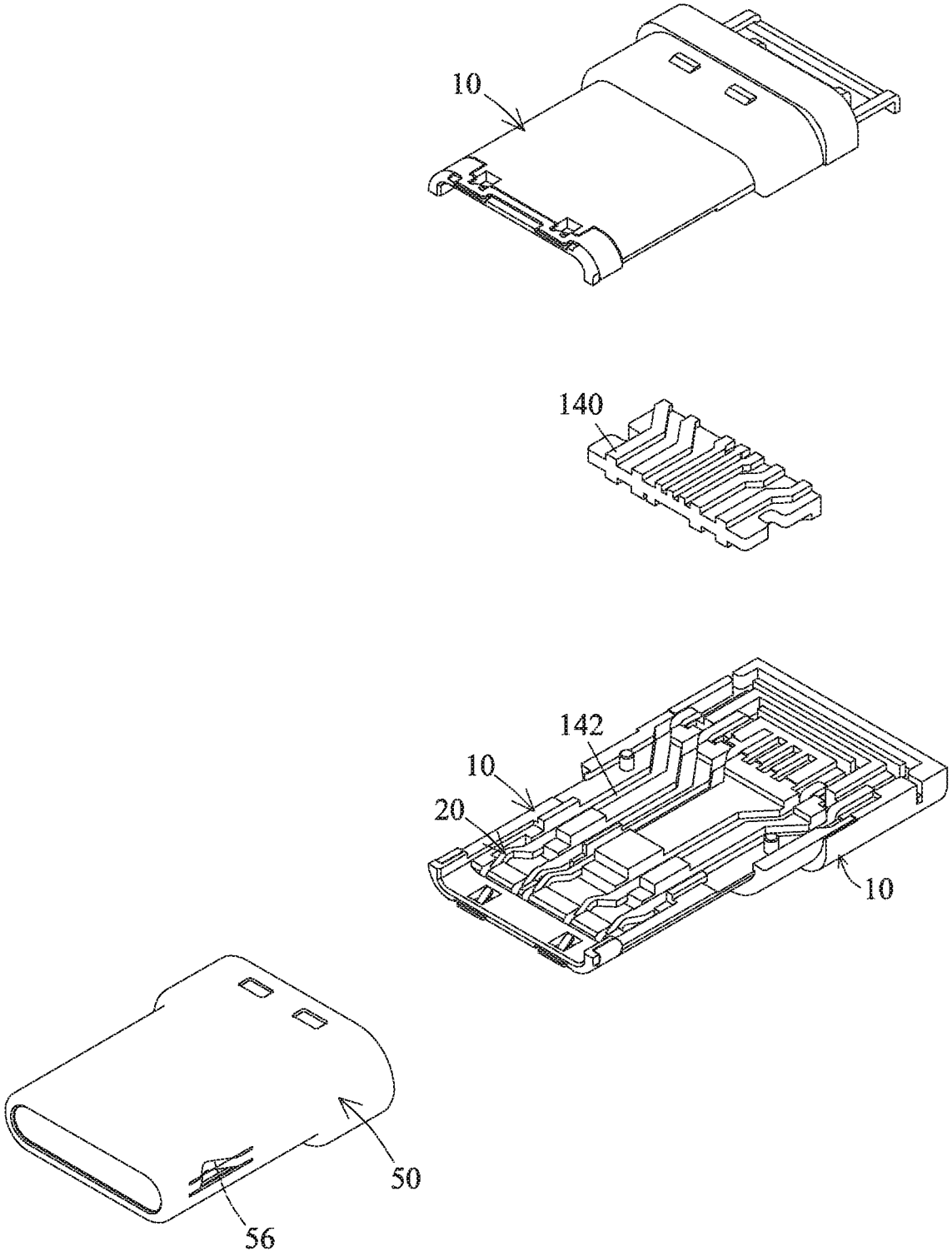
FIG. 69 is a pictorially exploded view showing the thirteenth embodiment of the invention.

Referring to FIG. 69 according to the thirteenth embodiment of the invention is substantially the same as the twelfth embodiment. This embodiment is not provided with the metal partition plate, and the left and right sides of the metal housing 50 are integrally provided with inwardly projecting resilient snaps 56, wherein the plastic molded fixing structure 140 can be filled into the two rows of terminal slots 142 of the two insulation seats 10 to fix each terminal.

Figure 70:
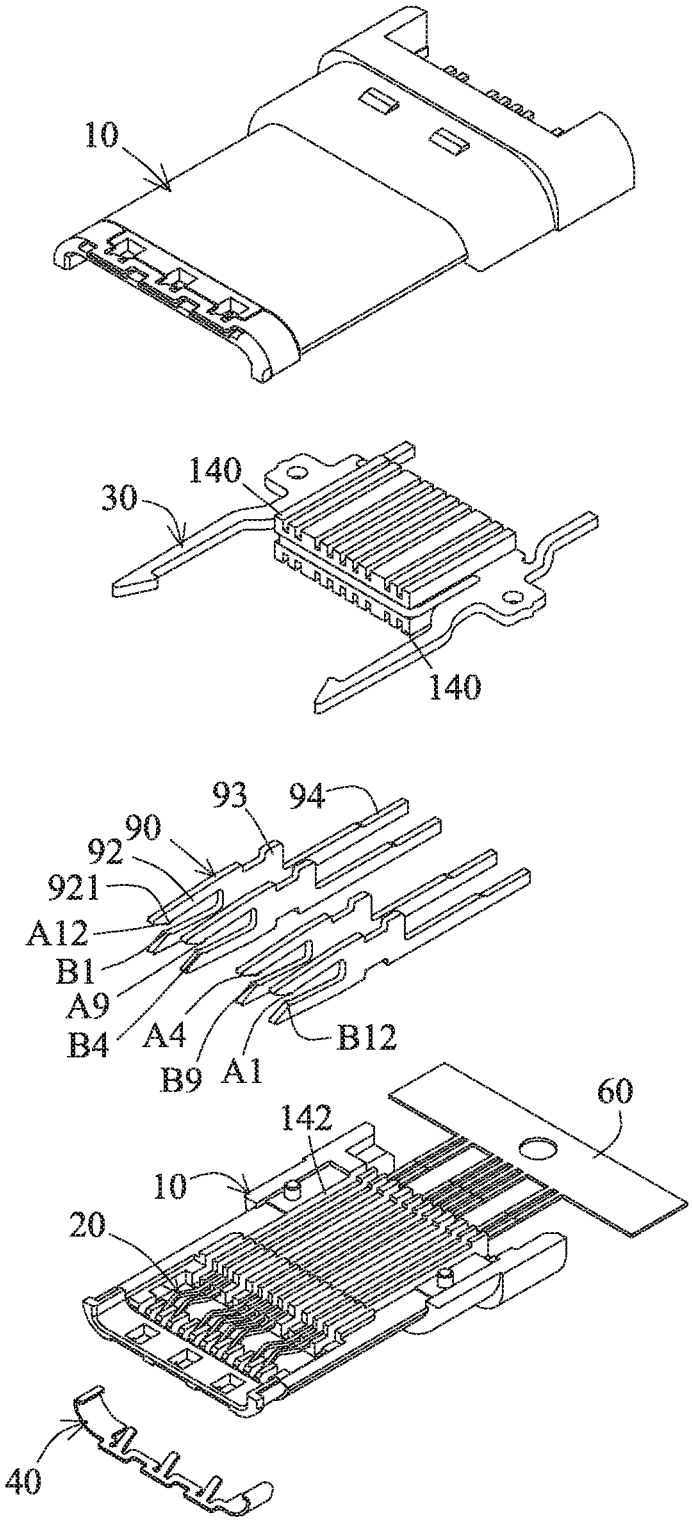
FIG. 70 is a pictorially exploded view showing the fourteenth embodiment of the invention.

Referring to FIG. 70 according to the fourteenth embodiment of the invention is substantially the same as the first embodiment. Similarly, the top and bottom surfaces of the metal partition plate 30 of this embodiment are embedded into and plastic injection molded with the fixing structures 140, and the fixing structures 140 are filled into the terminal slots 142 to fix each terminal.

In addition, the connector plug of each embodiment of the invention may also be disposed in various types of apparatuses and connected to various types of apparatuses. The apparatus may be, for example, an adapter cable, an adapter, an adapter device, a mouse, a keyboard, a power supply, a mouse, an earphone, a casing, a peripheral accessory product, a flash drive, a USB stick, a mobile hard drive, various storage apparatuses or instruments, a mobile power, a power bank, a charger, a wall charger, an expansion block, an expander, a notebook computer, a tablet computer, a mobile phone, various projection apparatus products, various wireless chargers, various wireless apparatus products, a setup box, a server, a desktop computer, various motion portable electronic apparatuses and instruments, a television, a playstation, various gaming apparatus products, various video apparatus products, various earphones, a microphone, a loudspeaker, various electronic lamp illuminating apparatus products, various electric fan apparatuses, various electronic elements, various ARs, a VR electronic apparatus product, or various other applicable electronic apparatus products.

In addition, because the bidirectional duplex connector of the invention has two contact interfaces, it may also use an anti-over-voltage, anti-overload current, anti-overheating, anti-short-circuit or anti-backflow element, such as a Schottky diode, a resistor, an allergy resistor, a capacitor or a magnetic bead, to function as the circuit safety protection. However, there may also be various implementations, such as the Schottky diode for anti-short-circuit; a resistor, an allergy resistor, a capacitor, a magnetic beads for anti-overvoltage, anti-overload current, anti-overheating; or an anti-backflow electrical element, an anti-short-circuit electrical element, a circuit safety protection element, or a safety circuit configuration means to achieve the circuit safety protection effect. In order to facilitate the examination, it is to be noted that claims 1-3 and 5-8 are implemented in FIGS. 1-16, claims 13-15 are implemented in FIGS. 22-23, and claims 10 and 16-18 are implemented in FIGS. 46-49.

The specific embodiments set forth in the detailed description of the preferred embodiments are merely illustrative of the technical details of the invention, and are not intended to limit the scope of the invention to the embodiments. Various modifications can be made without departing from the spirit of the invention and the following claims.

What is claimed is:

1. A bidirectional duplex electrical connector, comprising:

two insulation seats, wherein each of the insulation seats is integrally provided with a base portion and a docking portion, the docking portion is connected to a front end of the base portion, the docking portion is provided with a baseplate, the two insulation seats are stacked in an up-down direction, a connection slot is formed between the baseplates of the docking portions of the two insulation seats, and each of the inner surfaces of the two insulation seats is provided with one row of front-to-rear extending terminal slots;

two rows of first terminals formed by bending and stamping metal plate sheets, wherein the two rows of first terminals are assembled into two rows of terminal slots of the two insulation seats in the up-down direction, the first terminal is integrally provided with, from front to rear, an elastically movable portion, a fixing portion and a pin, a front section of the elastically movable portion corresponds to the docking portion and is provided with a contact projecting from the baseplate to the connection slot, the elastically movable portion is elastically movable up and down, both a rear section of the elastically movable portion and the fixing portion horizontally rest against a bottom surface of the terminal slot, the insulation seat is provided with a fixing structure fixing the fixing portions of the two row of first terminals, the rear sections of the elastically movable portions of the two row of first terminals can still move up and down elastically while resting against the bottom surfaces of the terminal slots, the pin extends to a rear end of the base portion and is exposed, and the contacts of the two rows of first terminals having the same circuits are arranged reversely;

one row of second terminals, which are formed by pressing a metal plate sheet, wherein the second terminal is integrally provided with two elastic arms, a fixing portion and a pin, the two elastic arms have a harpoon-like shape, each of the two elastic arms is provided with a contact projecting toward a middle, the two contacts are aligned in the up-down direction with a gap formed between the two contacts, the two elastic arms are elastically movable up and down in a direction parallel to a plate surface direction, the one row of second terminals are assembled, into two rows of terminal slots of the two insulation seats, and the second terminal has a vertical plate surface; and a metal housing, which covers the two insulation seats and is provided with a four-sided main housing, wherein the four-sided main housing covers the docking portions of the two insulation seats to form a docking structure, and the docking structure can be positioned with a docking electrical connector in a dual-positional and bidirectional manner, wherein when the elastically movable portion of each of the two rows of first terminals is forced to move elastically, the elastically movable portion is formed with a middle-section fulcrum supported by the bottom surface of the terminal slot, so that the rear section of the elastically movable portion at the rear of the middle-section fulcrum can be curved to move elastically to form a gap between the bottom surface of the terminal slot of the base portion and the rear section of the elastically movable portion.

2. The bidirectional duplex electrical connector according to claim 1, wherein the one row of second terminals have four terminals, which are respectively two ground terminals and two power terminals.

3. A bidirectional duplex electrical connector, comprising:

two insulation seats, wherein each of the insulation seats is integrally provided with a base portion and a docking portion, the docking portion is connected to a front end of the base portion, the docking portion is provided with a baseplate, the two insulation seats are stacked in an up-down direction, a connection slot is formed between the baseplates of the docking portions of the two insulation seats, and each of the inner surfaces of the two insulation seats is provided with one row of front-to-rear extending terminal slots;

two rows of terminals, which are formed by bending and stamping metal plate sheets, the two rows of terminals are assembled into two rows of terminal slots of the two insulation seats in the up-down direction, the terminal is integrally provided with, from front to rear, an elastically movable portion, a fixing portion and a pin, a front section of the elastically movable portion corresponds to the docking portion and is provided with a contact projecting from the baseplate to the connection slot, the elastically movable portion is elastically movable up and down, both a rear section of the elastically movable portion and the fixing portion horizontally rest against a bottom surface of the terminal slot, the elastically movable portion has a resilient overpressure toward a bottom surface of the terminal slot to ensure that each row of contacts have consistent heights when two rows of terminals are assembled into the terminal slots, the insulation seat is provided with a fixing structure fixing the fixing portions of the two row of terminals, the rear sections of the elastically movable portions of the two row of terminals still can still move up and down elastically while resting against the bottom surfaces of the terminal slots, the pin extends to a rear end of the base portion and is exposed, and the contacts of the two rows of terminals having the same circuits are arranged reversely; and a metal housing, which covers the two insulation seats and is provided with a four-sided main housing, wherein the four-sided main housing covers the docking portions of the two insulation seats to form a docking structure, and the docking structure can be positioned with a docking electrical connector in a dual-positional and bidirectional manner, wherein when the elastically movable portion of each of the two rows of terminals is forced to move elastically, the elastically movable portion is formed with a middle-section fulcrum supported by the bottom surface of the terminal slot, so that the rear section of the elastically movable portion at the rear of the middle-section fulcrum can be curved to move elastically to form a gap between the bottom surface of the terminal slot of the base portion and the rear section of the elastically movable portion.

4. The bidirectional duplex electrical connector according to claim 1 satisfying one of (a) to (d):

(a) wherein the fixing structure is formed by encapsulant;

(b) wherein the fixing structure is formed by way of hot melting;

(c) wherein the fixing structure is a slot structure, and when the first terminal is placed into the terminal slot in the vertical direction and then shifted in a front-rear direction, the fixing portion of the first terminal can be locked with the slot structure; and (d) wherein the fixing structure is an insulator, which is assembled between the two insulation seats and rests against and fix the fixing portions of the two rows of first terminals.

5. The bidirectional duplex electrical connector according to claim 1, wherein at least one ground member is provided between the two insulation seats and the metal housing, a front section of the baseplate is provided with a front section surface and a rear section of the baseplate is provided with a rear section surface, the rear section surface projects beyond the front section surface by a height, the two rows of contacts project beyond the rear section surface, and the ground member is connected to at least one elastic sheet projecting beyond the front section surface and stretching into the connection slot; or wherein each of the inner surfaces of the two insulation seats is provided with one row of separation columns performing separation to form one row of front-to-rear extending terminal slots, and the terminal slot extends from the base portion to the docking portion; or wherein a depth of the terminal slot is larger than a material thickness of the first terminal, so that a part of the elastically movable portion and the fixing portion fall into the terminal slot; or wherein a metal partition plate is provided between the two insulation seats, and two sides of the metal partition plate are integrally connected to and provided with elastically movable snaps stretching into two sides of the connection slot; or wherein the one row of second terminals are one row of loose pin type terminals; or wherein the inner surfaces of the base portion of the two insulation seats mutually rest against each other; or wherein the docking portion is provided with two side plates.

6. The bidirectional duplex electrical connector according to claim 1, wherein a connection material bridge is provided between the two insulation seats and mutually connects the two insulation seats to each other, so that the two insulation seats are one-time plastic injection molded; or wherein a connection material bridge is provided between the two insulation seats and mutually connects the two insulation seats to each other, the connection material bridge is a plastic material bridges, and the plastic material bridge and the two insulation seats are integrally plastic injection molded; or wherein a cut mark is formed on a stacked portion of sides of the two insulation seats.

7. The bidirectional duplex electrical connector according to claim 1, wherein the elastically movable portion has a resilient overpressure toward a bottom surface of the terminal slot to ensure that each row of contacts have consistent heights.

8. The bidirectional duplex electrical connector according to claim 3 satisfying one of (a) to (d):

(a) wherein the fixing structure is formed by encapsulant;

(b) wherein the fixing structure is formed by way of hot melting;

(c) wherein the fixing structure is a slot structure, and when the first terminal is placed into the terminal slot in the vertical direction and then shifted in a front-rear direction, the fixing portion of the first terminal can be locked with the slot structure; and (d) wherein the fixing structure is an insulator, which is assembled between the two insulation seats and rests against and fix the fixing portions of the two rows of terminals.

9. The bidirectional duplex electrical connector according to claim 3, wherein two outer sides of each of the two rows of terminals are provided with one pair of ground terminals arranged in a left-right symmetrical manner, a middle of each of the two rows of terminals is provided with one pair of power terminals arranged in the left-right symmetrical manner, two pairs of contacts of the two pairs of ground terminals of the two rows of terminals are vertically aligned, two pairs of contacts of the two pairs of power terminals of the two rows of terminals are vertically aligned, the one pair of ground terminals of at least one row of terminals of the two rows of terminals are integrally connected to a large U-shaped connection sheet, the one pair of power terminals of at least one row of terminals of the two rows of terminals are integrally connected to a small U-shaped connection sheet, the large U-shaped connection sheet is disposed outside the small U-shaped connection sheet so that a form of a large U shape covering a small U shape is formed, the two ground terminals having the two vertically aligned contacts have the two pins adjacently arranged, and the two power terminals having the two vertically aligned contacts have the two pins adjacently arranged, so that a number of bonding wires of the pins can be decreased.

10. The bidirectional duplex electrical connector according to claim 3, wherein at least one ground member is provided between the two insulation seats and the metal housing, a front section of the baseplate is provided with a front section surface and a rear section of the baseplate is provided with a rear section surface, the rear section surface projects beyond the front section surface by a height, the two rows of contacts project beyond the rear section surface, and the ground member is connected to at least one elastic sheet projecting beyond the front section surface and stretching into the connection slot; or wherein each of the inner surfaces of the two insulation seats is provided with one row of separation columns performing separation to form one row of front-to-rear extending terminal slots, and the terminal slot extends from the base portion to the docking portion; or wherein a depth of the terminal slot is larger than a material thickness of the first terminal, so that a part of the elastically movable portion and the fixing portion fall into the terminal slot; or wherein a metal partition plate is provided between the two insulation seats, and two sides of the metal partition plate are integrally connected to and provided with elastically movable snaps stretching into two sides of the connection slot; or wherein the inner surfaces of the base portion of the two insulation seats mutually rest against each other; or wherein the docking portion is provided with two side plates.

11. The bidirectional duplex electrical connector according to claim 3, wherein a connection material bridge is provided between the two insulation seats and mutually connects the two insulation seats to each other, so that the two insulation seats are one-time plastic injection molded; or wherein a connection material bridge is provided between the two insulation seats and mutually connects the two insulation seats to each other, the connection material bridge is a plastic material bridges, and the plastic material bridge and the two insulation seats are integrally plastic injection molded; or wherein a cut mark is formed on a stacked portion of sides of the two insulation seats.

12. A bidirectional duplex electrical connector, comprising:

two insulation seats, wherein each of the insulation seats is integrally provided with a base portion and a docking portion, the docking portion is connected to a front end of the base portion, the docking portion is provided with a baseplate, the two insulation seats are stacked in an up-down direction, a connection slot is formed between the baseplates of the docking portions of the two insulation seats, and each of the inner surfaces of the two insulation seats is provided with one row of front-to-rear extending terminal slots;

two rows of terminals, which are formed by bending and stamping metal plate sheets, the two rows of terminals are assembled into two rows of terminal slots of the two insulation seats in the up-down direction, the terminal is integrally provided with, from front to rear, an elastically movable portion, a fixing portion and a pin, a front section of the elastically movable portion corresponds to the docking portion and is provided with a contact projecting from the baseplate to the connection slot, the elastically movable portion is elastically movable up and down, both a rear section of the elastically movable portion and the fixing portion horizontally rest against a bottom surface of the terminal slot, the pin extends to a rear end of the base portion and is exposed, and the contacts of the two rows of terminals having the same circuits are arranged reversely;

a fixing structure, wherein the fixing structure is an insulator assembled between the two insulation seats and rests against and fix the fixing portions of the two rows of terminals, rear sections of the elastically movable portions of the two row of terminals can still move up and down elastically while resting against the bottom surfaces of the terminal slots to; and a metal housing, which covers the two insulation seats and is provided with a four-sided main housing, wherein the four-sided main housing covers the docking portions of the two insulation seats to form a docking structure, and the docking structure can be positioned with a docking electrical connector in a dual-positional and bidirectional manner, wherein when the elastically movable portion of each of the two rows of terminals is forced to move elastically, the elastically movable portion is formed with a middle-section fulcrum supported at the bottom surface of the terminal slot, so that the rear section of the elastically movable portion at the rear of the middle-section fulcrum can be curved to move elastically to form a gap between the bottom surface of the terminal slot of the base portion and the rear section of the elastically movable portion.

13. The bidirectional duplex electrical connector according to claim 12, wherein a metal partition plate is provided between the two insulation seats, and two sides of the metal partition plate are integrally connected to and provided with elastically movable snaps stretching into two sides of the connection slot, and top and bottom surfaces of the metal partition plate are embedded into and plastic injection molded with the fixing structure.

14. The bidirectional duplex electrical connector according to claim 12, wherein each of top and bottom surfaces of the fixing structure is provided with multiple convex surfaces and multiple concave surfaces spaced apart, respectively, and the multiple convex surfaces can extend into the two rows of terminal slots to fix the fixing portion of each terminal.

15. The bidirectional duplex electrical connector according to claim 12, wherein two outer sides of each of the two rows of terminals are provided with one pair of ground terminals arranged in a left-right symmetrical manner, a middle of each of the two rows of terminals is provided with one pair of power terminals arranged in the left-right symmetrical manner, two pairs of contacts of the two pairs of ground terminals of the two rows of terminals are vertically aligned, two pairs of contacts of the two pairs of power terminals of the two rows of terminals are vertically aligned, the one pair of ground terminals of at least one row of terminals of the two rows of terminals are integrally connected to a large U-shaped connection sheet, the one pair of power terminals of at least one row of terminals of the two rows of terminals are integrally connected to a small U-shaped connection sheet, the large U-shaped connection sheet is disposed outside the small U-shaped connection sheet so that a form of a large U shape covering a small U shape is formed, the two ground terminals having the two vertically aligned contacts have the two pins adjacently arranged, and the two power terminals having the two vertically aligned contacts have the two pins adjacently arranged, so that a number of bonding wires of the pins can be decreased.

16. The bidirectional duplex electrical connector according to claim 15, wherein both the large and small U-shaped connection sheets extend backwards and bypass the pin of a middle terminal of the one row of terminals.

17. The bidirectional duplex electrical connector according to claim 16, wherein in the one row of terminals, the large U-shaped connection sheet and the pins extending horizontally have a height difference, and in the one row of terminals, the small U-shaped connection sheet and the pins extending horizontally have a height difference.

18. The bidirectional duplex electrical connector according to claim 12, wherein at least one ground member is provided between the two insulation seats and the metal housing, a front section of the baseplate is provided with a front section surface and a rear section of the baseplate is provided with a rear section surface, the rear section surface projects beyond the front section surface by a height, the two rows of contacts project beyond the rear section surface, and the ground member is connected to at least one elastic sheet projecting beyond the front section surface and stretching into the connection slot; or wherein each of the inner surfaces of the two insulation seats is provided with one row of separation columns performing separation to form one row of front-to-rear extending terminal slots, and the terminal slot extends from the base portion to the docking portion; or wherein a depth of the terminal slot is larger than a material thickness of the first terminal, so that a part of the elastically movable portion and the fixing portion fall into the terminal slot; or wherein a metal partition plate is provided between the two insulation seats, and two sides of the metal partition plate are integrally connected to and provided with elastically movable snaps stretching into two sides of the connection slot; or wherein the inner surfaces of the base portion of the two insulation seats mutually rest against each other; or wherein the docking portion is provided with two side plates.

19. The bidirectional duplex electrical connector according to claim 12, wherein a connection material bridge is provided between the two insulation seats and mutually connects the two insulation seats to each other, so that the two insulation seats are one-time plastic injection molded; or wherein a connection material bridge is provided between the two insulation seats and mutually connects the two insulation seats to each other, the connection material bridge is a plastic material bridges, and the plastic material bridge and the two insulation seats are integrally plastic injection molded; or wherein a cut mark is formed on a stacked portion of sides of the two insulation seats.

20. The bidirectional duplex electrical connector according to claim 12, wherein the elastically movable portion has a resilient overpressure toward a bottom surface of the terminal slot to ensure that each row of contacts have consistent heights.

* * * * *